US008115092B2

(12) United States Patent
Tominaga

(10) Patent No.: US 8,115,092 B2
(45) Date of Patent: Feb. 14, 2012

(54) METHOD FOR SYNTHESIZING TONE SIGNAL AND TONE SIGNAL GENERATING SYSTEM

(75) Inventor: Eiji Tominaga, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 10 days.

(21) Appl. No.: 12/788,897

(22) Filed: May 27, 2010

(65) Prior Publication Data

US 2010/0307322 A1 Dec. 9, 2010

(30) Foreign Application Priority Data

Jun. 3, 2009 (JP) ..... 2009-134512
Jun. 3, 2009 (JP) ..... 2009-134513
Jun. 3, 2009 (JP) ..... 2009-134514

(51) Int. Cl.
*G10H 1/02* (2006.01)

(52) U.S. Cl. ..... 84/719; 84/600; 84/626; 84/662

(58) Field of Classification Search ..... None
See application file for complete search history.

(56) References Cited

U.S. PATENT DOCUMENTS 5,247,129 A * 9/1993 Nozaki et al. ..... 84/615
5,949,013 A * 9/1999 Satoshi ..... 84/719
2010/0307322 A1* 12/2010 Tominaga ..... 84/622

FOREIGN PATENT DOCUMENTS

WO 2008-012412 A2 1/2008

OTHER PUBLICATIONS

"Physical Modeling of the Piano", Giordano, et al., Eurasip Journal of Applied Signal Processing, Hindawi Publishing Co., Cuyahoga Falls, OH, US; vol. 2004, No. 7, Jul. 1, 2004, pp. 926-933.
"The Simulation of Piano String Vibration: From Physical Models to Finite Difference Schemes and Digital Waveguides", Bensa, et al., The Journal of the Acoustical Society of America, American Institute of Physics for the Acoustical Society o America, New York, NY, US; vol. 114, No. 2, Aug. 1, 2003, pp. 1095-1107.
"Object-Based Sound Synthesis for Virtual Environments", Pedersini, et al., IEEE Signal Processing Magazine, IEEE Service Center, Piscataway, NJ, US; Vo. 17, No. 6, Nov. 1, 2000, pp. 37-51.

* cited by examiner

*Primary Examiner* — Marlo Fletcher
(74) *Attorney, Agent, or Firm* — Harness, Dickey & Pierce, PLC

(57) ABSTRACT

An electronic piano includes a tone signal synthesizing system implemented by software, keys and key sensors monitoring the keys and reporting the key positions to the tone signal synthesizing system, and the tone signal synthesizing system includes damper model calculating modules for determining resistance against vibrations of wires of an a piano, a hammer model calculating module for determining force exerted on the wires, string model calculating modules for determining force exerted on an instrument body of the piano by the wires on the basis of the resistance and force exerted on the wires, an instrument body model calculating module for determining displacements of instrument body on the basis of the force exerted on the instrument body and an air model calculating module for determining a sound pressure at an observation point from the displacement of instrument body.

16 Claims, 9 Drawing Sheets

METHOD FOR SYNTHESIZING TONE SIGNAL AND TONE SIGNAL GENERATING SYSTEM

FIELD OF THE INVENTION

This invention relates to a tone generating technology and, more particularly, to a tone signal generating system and a method for artificially generating tones which is prepared through a simulation on the basis of physical models of a tone generating mechanism of an acoustic musical instrument having wires and an instrument body for supporting the wires.

DESCRIPTION OF THE RELATED ART

There has been known a method of artificially generating tones. The method was developed through a simulation on a physical model for a sounding mechanism of an acoustic musical instrument by means of a special-purpose hardware, which is fabricated from a signal processor such as, for example, a DSP (Digital Signal Processor), a general-purpose processor and other sorts of digital circuits. The prior art method is available for synthesis of tones produced through acoustic musical instruments. In case where acoustic piano tones are artificially produced through the prior art method, the vibrations of wires are simulated on the basis of a string model, and the vibrations of bridges and a sound board, which the vibrating wires give rise to, are simulated on the basis of a sound board model. The prior art tone generating system, which contains the prior art simulators, carries out the simulations, and artificially produces the piano tones through the synthesis from the results of the simulations.

The prior art method is disclosed in Japan Patent Application laid-open No. Hei 06-83363, which is hereinafter referred to as "the first reference", and No. Hei 10-63270, which is hereinafter referred to as "the second reference" from aspects different from each other.

An electronic musical instrument is disclosed in the first reference, and two sorts of vibrations, i.e., the lateral vibrations and longitudinal vibrations are taken into account in the prior art electronic musical instrument. The prior art electronic musical instrument includes a lateral vibration simulating module, a longitudinal vibration simulating module and resonation simulating modules. Hammer signals, which are representative of pieces of music data, are supplied to the lateral vibration simulating module, and displacement signals, which are representative of the lateral vibrations, are produced through the lateral vibration simulating module. The lateral vibration simulating module is supplied from the lateral vibration simulating module to the longitudinal vibration simulating module, and longitudinal vibration signals are produced through the longitudinal vibration simulating module on the basis of the displacement signals. A first resonating signal is produced for resonance with the lateral vibrations through one of the resonance simulating modules, and a second resonating signal is produced for resonance with the longitudinal vibrations through the other of the resonance simulating modules. The displacement signals, longitudinal vibration signals, first resonating signal and second resonating signals are added to one another for synthesis of waveform of tones.

A prior art tone synthesizer is disclosed in the second reference. The prior art tone synthesizer includes a loop circuit for a string model and a loop circuit for a sound board system. The loop circuit has delay circuits for simulating propagation delay in wire vibrations and a terminating filter for simulating acoustic losses in the wire. The loop circuit for the sound board system has an adder, multipliers and a sound board with a predetermined transfer function. The loop circuit for the string model is connected to the loop circuit for the sound board system through a waveguide junction, and output signals from the loop circuits are properly weighted in the tone synthesis.

Although both of the wire vibrations and resonance are taken into account in the prior art electronic musical instrument and prior art electronic musical instrument, persons with fine ears for music feel the synthesized tones not close to the tones generated through the acoustic musical instrument such as a piano.

Moreover, the acoustic musical instrument is equipped with several pedals and levers for imparting various nuances to the acoustic tones. A piano is, by way of example, equipped with a damper pedal and a soft pedal. When a player depresses the damper pedal over a relatively long pedal stroke, the damper pedal keeps the dampers spaced from the wires in spite of the release of the depressed key. Certain persons in the art call the wires as "strings." As a result, the wire continuously vibrates after the key returns to the rest position, and the vibrating wire gives rise to strong vibrations of other wires through resonance. If the player depresses the damper pedal over a relatively short pedal stroke, the damper pedal keeps the dampers lightly in contact with the wires, and the loudness of piano tone is lessened, and the vibrating wire gives rise to weak vibrations of other wires in spite of the release of the key. The execution technique is called as "a half pedal." Thus, the player can impart either nuance to the piano tones.

The soft pedal is also available for the nuances. While the soft pedal is staying at the rest position, each of the hammer felts is opposed to three wires of an associated set, and the depressed key makes the hammer felt brought into collision with the three wires of the associated set. When the player depresses the soft pedal over a relatively long stroke, the key frame is laterally moved, and each of the hammers is opposed to two wires of the associated set. In this situation, the depressed key makes the hammer felt brought into collision with the two wires of the set so that the piano tone is generated at small loudness. If the player depresses the soft pedal over a relatively short stroke, the key frame is slightly moved in the lateral direction, and the three trails of hammer felt are offset from the three wires of associated set. Although the three trails have been hardened due to repetition of collision with the three wires of associated set, the areas of hammer felt beside the trails are soft. For this reason, when the hammer felt is brought into collision with the three wires of associated set, the piano tone is gentler than the piano tone generated through the collision between the three trails and the three wires. Thus, the player can impart different nuances to the piano tones through the soft pedal.

However, these sorts of influences of pedals are not taken into account in the prior art models. As a result, players can not impart the nuances to the synthetic tones generated through the prior art musical instruments.

SUMMARY OF THE INVENTION

It is therefore an important object of the present invention to provide a tone signal generating system, which produces a tone signal representative of synthetic tones close to acoustic tones produced through acoustic musical instruments.

It is also an important object of the present invention to provide a method, which is employed in the tone signal generating system.

The present inventor studied acoustic musical instruments, and noticed that not only the prior art models but also other models were required for a high-precision simulation. The other models were hereinafter described on a piano as an example of the acoustic musical instrument.

In detail, wires of piano were supported at one end thereof by a bearing on a frame and at the other hand thereof by a bridge on a sound board. When a player depressed a key, the key started to travel from the rest position toward the end position. The bearing is a part of a metal frame called as a ridge. The depressed key made an associated damper spaced from associated wires on the way to the end position, and gave kinetic energy to a hammer through an action unit also on the way to the end position. The hammer was brought into collision with the wires so that a wave was excited in the wires. The wave energy was propagated to the supported ends. Part of wave energy was transmitted through the supported ends to the frame. Remaining part of wave energy was reflected on the supported ends, and stayed in the wires. Thus, the wave was repeatedly propagated between the supported ends through the reflection so that vibrations took place in the wires. When the hammer was brought into collision with the wires, the hammer gave rise to bend of wires in the direction of the movement of hammer, i.e., a direction perpendicular to the longitudinal direction of wires. However, the bridge three-dimensionally vibrated. The wires were influenced by the vibrations of bridge, and vibrate not only the perpendicular direction but also a direction perpendicular to the perpendicular direction on the same virtual plane and the longitudinal direction.

The part of wave energy was propagated through the frame, sound board and cabinet. If the player depressed a damper pedal, the dampers were spaced from the other wires. In this situation, the other wires vibrated due to the energy transmitted from the frame, sound board and cabinet. Thus, the energy was transmitted from between the wires and the frame, sound board and cabinet for generating the acoustic piano tone. This phenomenon takes place through "a three-dimensional coupled vibration mechanism". The three-dimensional coupled vibration mechanism is simulated through "a three-dimensional coupled vibration model."

As described hereinbefore, the part of wave energy gave rise to the vibrations of a three-dimensional structure, i.e., the combination of vibratory component parts such as the frame, sound board, a sideboard of cabinet and a wooden frame of cabinet, and the acoustic piano tone was radiated from the vibrating three-dimensional structure to the air. The combination of vibratory component parts was hereinafter referred to as "instrument body." The phenomenon took place through "an acoustic radiation mechanism from three-dimensional instrument body." The acoustic radiation mechanism from three-dimensional instrument body was simulated through "an acoustic radiation model from three dimensional instrument body."

A standard acoustic piano had eighty-eight keys, and pitches of the scale were respectively assigned to the eighty-eight keys. When a player sequentially depressed the eighty-eight keys, the tones were generated at predetermined pitches. However, the persons with fine ears for music felt the piano tones, which were generated from the vibrating wires associated with the forty keys from the key assigned the lowest pitch, slightly different in tone color from the piano tones generated from the vibrating wires associated with the other keys. The persons notified these piano tones containing non-harmonic sound. They expressed the non-harmonic sound as a sort of bell sound such as "jingling" or "whinnying" or a sort of metallic sound such as "tinkling", and was hereinafter referred to as "ringing sound". The stronger the player brought the hammer into collision with the wires, the more the piano tone contained the ringing sound. If the piano tone contained the ringing sound too much, the persons felt the ringing sound unpleasant. However, if the ringing sound was perfectly removed, the persons felt the piano tone too monotony. The origin of ringing sound was non-linear finite-amplitude vibrations of wires. The phenomenon took place through "a non-linear finite-amplitude vibration mechanism, and the non-linear finite-amplitude vibration mechanism was simulated through "a non-linear finite-amplitude vibration model."

The present inventor concluded that the above-described mechanisms were selectively to be taken into account for synthesis of tones closer to acoustic tones.

To accomplish the object, the present invention proposes to take the three-dimensional coupled vibration model and acoustic radiation model from three dimensional instrument body into account for improvement of electronic tones. The three-dimensional coupled vibration model results in a string model and an instrument body model, and the acoustic radiation model results in an air model.

In accordance with one aspect of the present invention, there is provided a method of simulating acoustic tones produced through an acoustic musical instrument having at least one vibratory wire and a vibratory instrument body provided with supporting portions through which the aforesaid at least one wire is supported for producing a tone signal representative of artificial tones close to the acoustic tones and observed at a certain point in the air, and the method comprises the steps of a) acquiring a first piece of data expressing force exerted on the aforesaid at least one vibratory wire and a second piece of data expressing a displacement at each of the supporting portions, b) determining a third piece of data expressing a displacement of the aforesaid at least one vibratory wire on a modal coordinate system for each natural vibration mode by using an equation of motion defining relation between the force exerted on the aforesaid at least one vibratory wire and the displacement at each of the supporting portions and the displacement of the at least one vibratory wire on a modal coordinate system for each natural vibration mode, c) determining a fourth piece of data expressing force exerted on the supporting portions by the aforesaid at least one vibratory wire on the basis of the second piece of the data by using a direction cosine among the coordinate axes and equations defining relation between a displacement of the supporting portions and the force exerted on the supporting portions and the displacement expressed by the third piece of data, d) determining a fifth piece of data expressing a displacement or a velocity of the vibratory instrument body on a modal coordinate system approximated to a proportional viscous damping system on the basis of the fourth piece of data and a sixth piece of data expressing a natural angular frequency, a modal damping ratio and components of natural vibration modes of the vibratory instrument body by using an equation of motion defining relation between the fourth piece of data and the fifth piece of data, e) determining the second piece of data as a sum of products among values of the fifth piece of data, natural vibration modes of the vibratory instrument body at the supporting portions and a direction cosine among the coordinate axes, f) supplying the second piece of data to the step a), g) determining a seventh piece of data expressing a sound pressure radiated from the vibratory instrument body and observed at the certain point in the air on the basis of the fifth piece of data as a sum of calculation results through a convolution between a velocity of said vibratory instrument body on said modal coordinate system and an eighth piece of data expressing an impulse response or a frequency response between the velocity of said vibratory instrument body on said modal coordinate system and said sound pressure at said certain point in the air, and h) producing the tone signal representative of the seventh piece of data and expressing the artificial tones.

In accordance with another aspect of the present invention, there is provided a tone signal synthesizing system for producing a tone signal representative of artificial tones close to acoustic tones produced through an acoustic musical instrument having at least one vibratory wire and a vibratory instrument body provided with supporting portions through which the aforesaid at least one wire is supported, and the tone signal synthesizing system comprises a string model calculating module including a first sub-module acquiring a first piece of data expressing force exerted on the aforesaid at least one vibratory wire and a second piece of data expressing a displacement at each of the supporting portions, a second sub-module determining a third piece of data expressing a displacement of the aforesaid at least one vibratory wire on a modal coordinate system for each natural vibration mode by using an equation of motion defining relation between the force exerted on the aforesaid at least one vibratory wire and the displacement at each of the supporting portions and the displacement of the at least one vibratory wire on a modal coordinate system for each natural vibration mode and a third sub-module determining a fourth piece of data expressing force exerted on the supporting portions by the aforesaid at least one vibratory wire on the basis of the second piece of data by using a direction cosine among the coordinate axes and equations defining relation between a displacement of the supporting portions and the force exerted on the supporting portions and the displacement expressed by the third piece of data, an instrument body model calculating module including a fourth sub-module determining a fifth piece of data expressing a displacement or a velocity of the vibratory instrument body on the modal coordinate system approximated to a proportional viscous damping system on the basis of the fourth piece of data and a sixth piece of data expressing a natural angular frequency, a modal damping ratio and components of natural vibration modes of the vibratory instrument body by using an equation of motion defining relation between the fourth piece of data and the fifth piece of data, a fifth sub-module determining the second piece of data as a sum of products among values of the fifth piece of data, natural vibration modes of the vibratory instrument body at the supporting portions and said direction cosine among the coordinate axes and a sixth sub-module supplying the second piece of data to the string model calculating module, and an air model calculating module having a seventh sub-model determining a seventh piece of data expressing a sound pressure radiated from the vibratory instrument body and observed at the certain point in the air on the basis of the fifth piece of data as a sum of calculation results through a convolution between a velocity of said vibratory instrument body on said modal coordinate system and an eighth piece of data expressing an impulse response or a frequency response between said velocity of said vibratory instrument body on said modal coordinate system and said sound pressure at said certain point in the air and an eighth sub-module producing a tone signal representative of the seventh piece of data and expressing the artificial tones.

In accordance with yet another aspect of the present invention, there is provided a method of simulating an acoustic tone produced through an acoustic piano for producing a tone signal representative of artificial tones close to the acoustic tones and observed, the acoustic piano includes at least one key moved between a rest position and an end position, at least one action unit linked with the aforesaid at least one key, at least one hammer driven for rotation by the aforesaid at least one action unit, at least one vibratory wire, at least one damper linked with the aforesaid at least one key so as to be spaced from and brought into contact with the aforesaid at least one vibratory wire depending upon a position of the aforesaid at least one key, a damper pedal linked with the aforesaid at least one damper so as to make the aforesaid at least one damper spaced from and brought into contact with the aforesaid at least one vibratory wire independent of the position of the aforesaid at least one key and a vibratory instrument body provided with supporting portions through which the aforesaid at least one wire is supported, and the method comprises the steps of a) acquiring a first piece of data expressing a stroke of a key corresponding to the aforesaid at least one key and a second piece of data expressing a stroke of a pedal corresponding to the damper pedal, b) determining a third piece of data expressing resistance against the aforesaid at least one wire by the aforesaid at least one damper by varying a value of viscous coefficient of the aforesaid at least one damper on the basis of the first and second pieces of data in a time dependent manner and c) determining the tone signal in consideration of the third piece of data.

In accordance with still another aspect of the present invention, there is provided a tone signal synthesizing system for producing a tone signal representative of an artificial tone close to an acoustic tone produced through a piano including at least one key moved between a rest position and an end position, at least one action unit linked with the aforesaid at least one key, at least one hammer driven for rotation by the aforesaid at least one action unit, at least one vibratory wire, at least one damper linked with the aforesaid at least one key so as to be spaced from and brought into contact with the aforesaid at least one vibratory wire depending upon a position of the aforesaid at least one key, a damper pedal linked with the aforesaid at least one damper so as to make the aforesaid at least one damper spaced from and brought into contact with the aforesaid at least one vibratory wire independent of the position of the aforesaid at least one key and a vibratory instrument body provided with supporting portions through which the aforesaid at least one wire is supported, and the tone signal synthesizing system comprises a damper model calculating module including a first sub-module acquiring a first piece of data expressing a stroke of a key corresponding to the aforesaid at least one key and a second piece of data expressing a stroke of a pedal corresponding to the damper pedal and a second sub-module determining a third piece of data expressing resistance against vibrations of the aforesaid at least one wire by the aforesaid at least one damper by varying a value of viscous coefficient of the aforesaid at least one damper on the basis of the first and second pieces of data in a time dependent manner and a tone signal producing module determining the tone signal in consideration of the third piece of data.

In accordance with yet another aspect of the present invention, there is provided a method of simulating an acoustic tone produced through an acoustic piano for producing a tone signal representative of artificial tones close to the acoustic tones, the acoustic piano includes at least one key moved between a rest position and an end position, at least one action unit linked with the aforesaid at least one key, at least one hammer driven for rotation by the aforesaid at least one action unit, at least one vibratory wire, at least one damper linked with the aforesaid at least one key so as to be spaced from and brought into contact with the aforesaid at least one vibratory wire depending upon a position of the aforesaid at least one key, a soft pedal linked with the aforesaid at least one key so as to make an impact area of the aforesaid hammer offset from the aforesaid at least one vibratory wire and a vibratory instrument body provided with supporting portions through which the aforesaid at least one wire is supported, and the method comprises the steps of a) acquiring a first piece of data expressing a stroke of a pedal corresponding to the soft pedal, b) determining a second piece of data expressing force exerted on the aforesaid at least one wire by the aforesaid at least one hammer by varying a value of modulus of elasticity of the aforesaid at least one hammer on the basis of the first piece of data in a time dependent manner and c) determining the tone signal in consideration of the second piece of data.

In accordance with still another aspect of the present invention, there is provided a tone signals synthesizing system for producing a tone signal representative of an artificial tone close to an acoustic tone produced through a piano including at least one key moved between a rest position and an end position, at least one action unit linked with the aforesaid at least one key, at least one hammer driven for rotation by the aforesaid at least one action unit, at least one vibratory wire, at least one damper linked with the aforesaid at least one key so as to be spaced from and brought into contact with the aforesaid at least one vibratory wire depending upon a position of the aforesaid at least one key, a soft pedal linked with the aforesaid at least one key so as to make an impact area of the hammer offset from the aforesaid at least one vibratory wire and a vibratory instrument body provided with supporting portions through which the aforesaid at least one wire is supported, and the tone signal synthesizing system comprises a hammer model calculating module including a first sub-module acquiring a first piece of data expressing a stroke of a pedal corresponding to the soft pedal and a second sub-module determining a second piece of data expressing force exerted on the aforesaid at least one wire by the aforesaid at least one hammer by varying a value of modulus of elasticity of the aforesaid at least one hammer on the basis of the first piece of data in a time dependent manner and a tone signal producing module determining the tone signal in consideration of the second piece of data.

BRIEF DESCRIPTION OF THE DRAWINGS

The features and advantages of the tone signal generating system and method will be more clearly understood from the following description taken in conjunction with the accompanying drawings, in which.

DESCRIPTION OF THE PREFERRED EMBODIMENTS

First Embodiment

System Configuration of Electronic Piano

Figure 1:
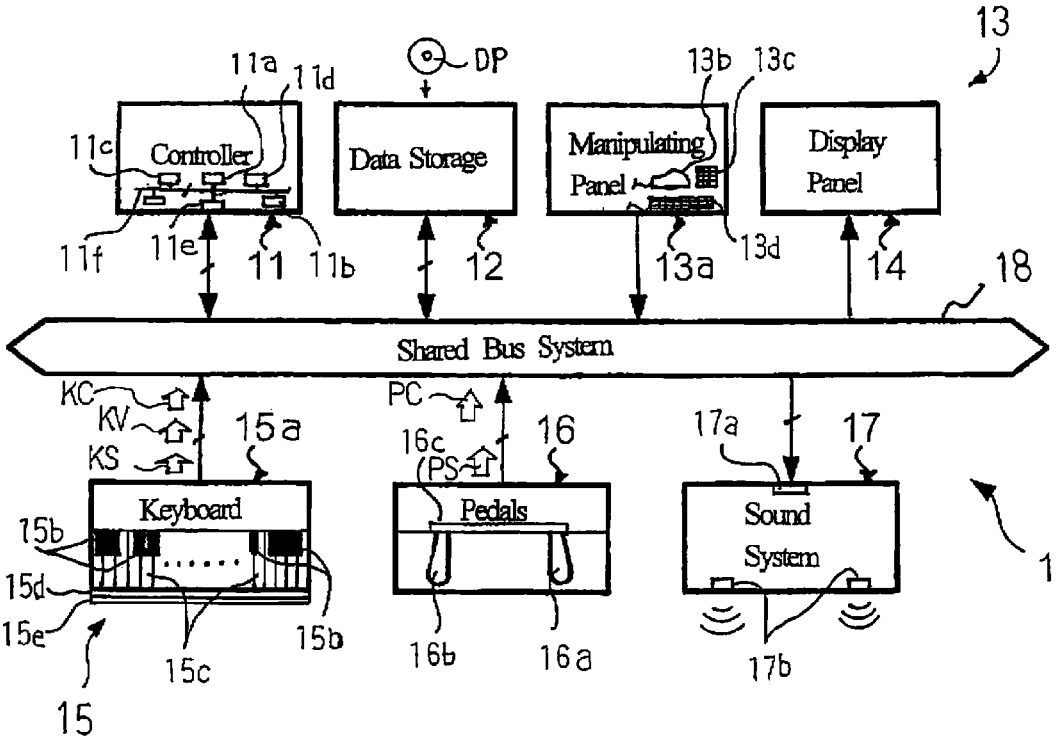
FIG. 1 is a block diagram showing the system configuration of an electronic piano of the present invention.

An electronic piano 1 embodying the present invention largely comprises a controller 11, a data storage 12, a man-machine interface 13, manipulators 15, a sound system 17 and a shared bus system 18. The controller 11, data storage 12, man-machine interface 13, manipulators 15 and sound system 17 are connected to the shared bus system 18 so that the controller 11 is communicable with the other system components 12, 13, 15 and 17 through the shared bus system 18.

The controller 11 is an origin of information processing capability, and includes a central processing unit 11*a*, a digital signal processor 11*b*, other peripheral processors (not shown), a read only memory 11*c*, a random access memory 11*d*, signal interfaces 11*e* and an internal bus system 11*f*. The central processing unit 11*a*, read only memory 11*c* and random access memory 11*d* are abbreviated as "CPU", "ROM" and "RAM". A direct memory access controller and a video processor may be contained as two of the other peripheral processors.

The central processing unit 11*a* is implemented by a microprocessor, and sequentially executes jobs expressed by programmed instruction codes of a computer program. The computer program is stored in the read only memory 11*c* so that the central processing unit 11*a* sequentially fetches the programmed instruction codes from the read only memory 11*c*. In case where the computer program is stored in the data storage 12, the computer program is transferred from the data storage 12 to the random access memory 11*d*, and the central processing unit 11*a* sequentially reads out the programmed instruction codes from the random access memory 11*d*. The random access memory 11*d* offers a working area to the central processing unit 11*a*.

The electronic piano 1 is controlled by the central processing unit 11*a* through the execution of programmed instruction codes. For example, the central processing unit 11*a* generates a tone signal with the assistance of the digital signal processor 11*b* as will be hereinlater described, and the tone signal is converted to electric tones through the sound system 17. In this instance, electronic piano tones are produced on the basis of the tone signal.

The data storage 12 has a large data holding capacity in a non-volatile manner. In this instance, a hard disk driving unit serves as the data storage 12. Various sorts of data are stored in the data storage 12. A set of pieces of tone controlling data and pieces of tone data are stored in the data storage 12. The pieces of tone controlling data may be prepared in accordance with MIDI (Musical Instrument Digital Interface) protocols. In this instance, the pieces of tone controlling data express a key stroke, a hammer velocity, a damper pedal stroke and a soft pedal stroke. A value of the key stroke, a value of hammer velocity, a value of damper pedal stroke and a value of soft pedal stroke are varied together with time. These sorts of data are loaded from an information storage medium DP such as a compact disk DP or a suitable server computer through a communication network.

The man-machine interface 13 includes a manipulating panel 13*a* and a display panel 14. A mouse 13*b*, switches 13*c* and a keyboard 13*d* form parts of the manipulating panel 13*a*, and users give their instructions to the electronic piano 1 through the mouse 13*b*, switches 13*c* and keyboard 13*d*.

In this instance, the display panel 14 is implemented by a liquid crystal display panel. The controller 11 makes the display panel 14 produce visual images such as messages, a list of jobs, a menu for performance and so forth through the execution of computer program. The visual images are produced without and in response to user's decision. For example, when the electronic piano 1 is electrically powered, visual images expressing the job list are produced on the display panel 14 without any user's instruction.

A keyboard 15*a* and pedals 16 are called as the manipulators 15. Black keys 15*b*, white keys 15*c*, an array of key position sensors 15*d* and an array of key velocity sensors 15*e* are incorporated in the keyboard 15*a*. While any downward force is not exerted on the keys 15*b*/15*c*, the keys are staying at respective rest positions, and the key stroke is zero. When the downward force is exerted on each of the keys 15*b*/15*c*, the key starts to travel from the rest position toward an end position. The key stroke is increased toward end positions. Key numbers are respectively assigned to the keys 15*b* and 15*c* so that depressed keys 15*b*/15*c* and released keys 15*b*/15*c* are specified with the key numbers.

The key position sensors 15*d* are respectively assigned to the keys 15*b* and 15*c*, and the key velocity sensors 15*e* are also assigned to the keys 15*b* and 15*c*, respectively. The key numbers are stored in key codes KC. Each of the keys 15*b* and 15*c* is monitored with one of the key position sensors 15*d* and one of the key velocity sensors 15*e*. The key stroke is measured from the rest position, and the key position sensors 15*d* produces key stroke signals. The key velocity sensors 15*e* produces key velocity signals. The key stroke signals and key velocity signals are converted from an analog form to a digital form, and the key codes KC, digital key stroke signals KS and digital key velocity signals KV are periodically supplied from the keyboard 15*a* to the signal interface 11*e* of the controller 11 through the shared bus system 18. The hammer velocity is determined on the basis of the acquired data by the controller 11.

The pedals 16 are corresponding to a damper pedal and a soft pedal, and, for this reason, the pedals 16 are hereinafter referred to as "a damper pedal 16*a*" and "a soft pedal 16*b*", respectively. Pedal numbers are respectively assigned to the pedals 16, and are stored in pedal codes PC. The depressed pedal and released pedal 16 are specified with the pedal codes PC. Pedal position sensors 16*c* are respectively assigned to the pedals 16*a* and 16*b*. While the damper pedal 16*a* and soft pedal 16*b* are staying at respective rest positions, the pedal stroke is zero. The values of pedal stroke are increased toward end positions. The pedal stroke signals are converted from the analog form to the digital form, and the digital pedal stroke signal PS and pedal code PC are periodically supplied through the shared bus system 18 to the signal interface 11*e* of the controller 11.

The sound system 17 includes a digital-to-analog converter 17*a*, amplifiers (not shown) and loud speakers 17*b*. A tone signal, which is representative of the pieces of tone data, is supplied to the sound system 17, and is converted from the digital form to an analog form through the digital-to-analog converter 17*a*. Thus, an audio signal is produced from the tone signal, and is converted to electric tones through the amplifiers and loud speakers 17*b*.

The computer program is broken down into a main routine program and subroutine programs. When the electronic piano 1 is initialized, the main routine program starts to run on the central processing unit 11*a*. While the main routine program is running on the central processing unit 11*a*, users give their instructions through the man-machine interface 13. One of the subroutine programs is assigned to data gathering, and the main routine program periodically branches to the subroutine program for data fetch from the signal interface 11*e*. Details of the main routine program and subroutine program for data gathering are known to persons skilled in the art, and, for this reason, no further description is hereinafter incorporated for the sake of simplicity.

Figure 2:
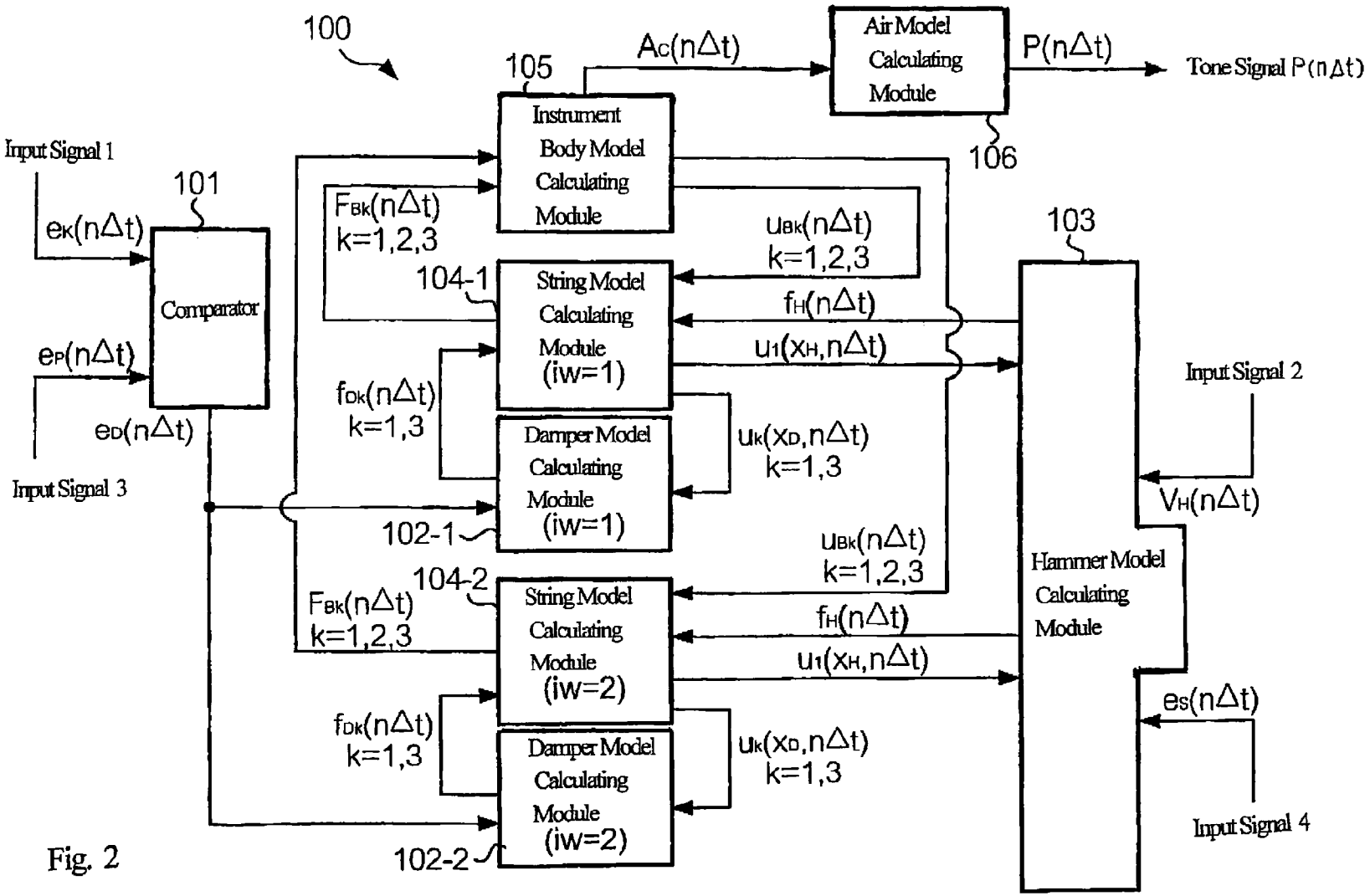
FIG. 2 is a block diagram showing software modules realized through execution of a part of computer program loaded in the electronic piano.

Another of the subroutine programs is assigned to synthesis of tone signal, and software modules shown in FIG. 2 are realized through execution of the subroutine program for synthesis of tone signal. Plural physical models are taken into account the subroutine program for synthesis of tone signal, and are referred to as "a damper model", "a hammer model", "a string model", "an instrument body model" and "an air model".

Figure 3:
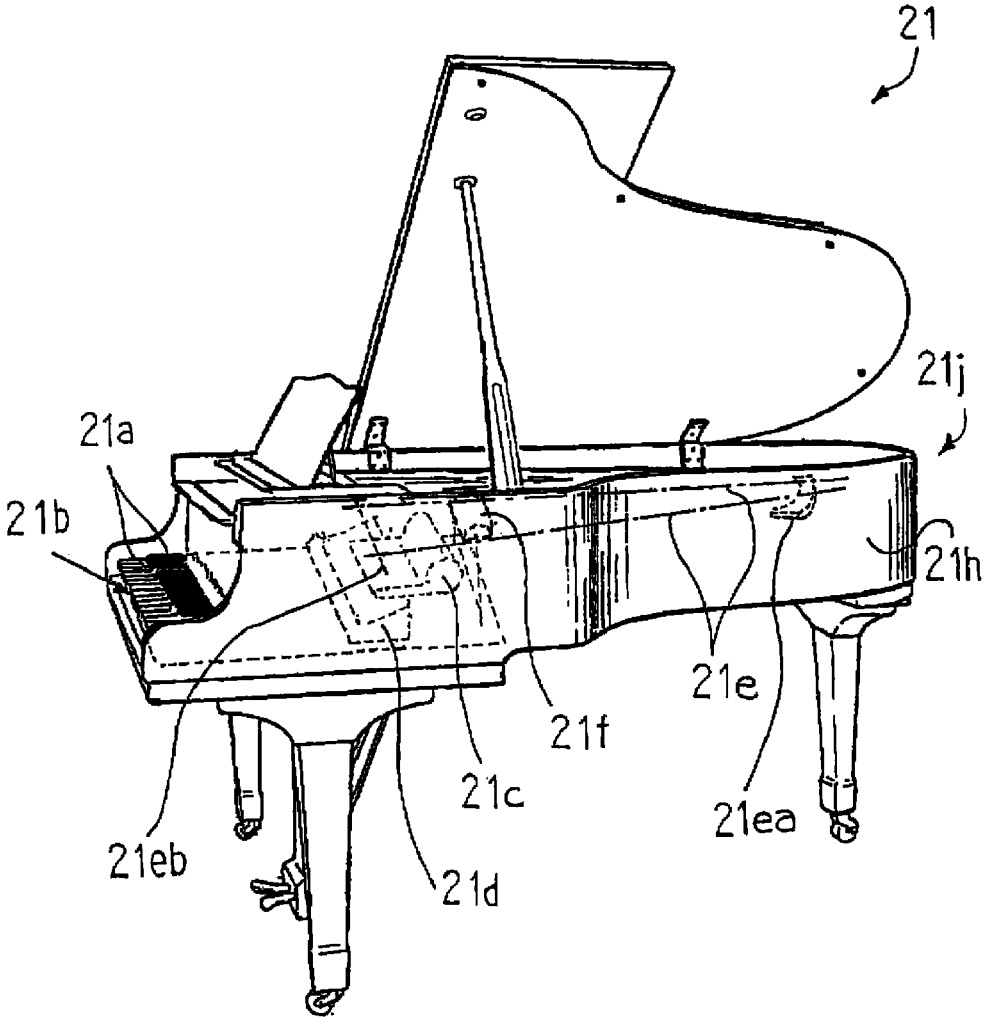
FIG. 3 is a schematic perspective view showing the structure of a standard grand piano.

These models are prepared on the premise that a standard acoustic piano. A typical example of the standard acoustic piano 21 is shown in FIG. 3, and the standard acoustic piano 21 includes eighty-eight keys 21*a* forming parts of a keyboard 21*b*, hammers 21*c* linked with the keys 21*a* through action units 21*d*, wire sets of wires 21*e* each constituted by a single to three wires and dampers 21*f* each brought into contact with the wire or wires 21*e* at zero to plural points. The wires 21*e* are connected at one ends thereof to bridges 21*ea* and at the other ends thereof to bearings 21*eb*. Most of keys 21*a*, hammers 21*c*, action units 21*d*, wires 21*e* and dampers 21*f* are accommodated in a cabinet 21*h*. The number of wires and contact points are varied from a register to another register. The piano cabinet 21*h*, frame, wood frame, bridges 21*ea*, bearings 21*eb* and other vibratory component parts radiating acoustic piano tones form an instrument body 21*j*.

In the following description, words "wires", "hammers", "dampers" and "instrument body" are indicative of the wires 21*e*, hammers 21*c*, dampers 21*f* and instrument body 21*j* of the standard acoustic piano 21, because neither wires, hammers, dampers nor instrument body are not incorporated in the electronic piano 1.

Tone Signal Synthesizing System

The subroutine program for synthesis of tone signal makes a tone signal synthesizing system 100 realized through the execution, and the tone signal synthesizing system 100 includes a comparator 101, damper model calculating modules 102-1 and 102-2, a hammer model calculating module 103, a string model calculating modules 104-1 and 104-2, an instrument body model calculating module 105 and an air model calculating module 106. The damper model calculating modules 102-1 and 102-2 simulate vibrations for a certain wire or wires 21*e* through the damper model, and the string model calculating modules 104-1 and 104-2 simulate vibrations for the certain wires 21*e* on the string model. The hammer model calculating module 103, instrument body calculating module 105 and air model calculating module 106 simulate vibrations for the certain wire or wires 21*e* through the hammer model, instrument body model and air model, respectively.

The comparator 101 is connected to the damper model calculating modules 102-1 and 102-2, and the damper model calculating modules 102-1 and 102-2 are respectively connected to the string model calculating modules 104-1 and 104-2. The hammer model calculating module 103 is connected to both of the string model calculating modules 104-1 and 104-2. The string model calculating modules 104-1 and 104-2 are connected to the instrument body calculating module 105, which in turn is connected to the air model calculating module 106. The tone generating signal $P(n\Delta t)$ is output from the air model calculating module 106.

As described hereinbefore, the tone signal synthesizing system 100 produces the tone signal on the premise that the standard acoustic piano 21 has the eighty-eight keys 21*a*. For this reason, the eighty-eight sets of damper model calculating modules 102-1 and 102-2, hammer model calculating module 103 and string model calculating modules 104-1 and 104-2 are required for the eighty-eight keys 15*b* and 15*c*, and the eighty-eight pairs of string model calculating modules 104-1 and 104-2 are connected in parallel to the instrument body model calculating module 105. In the following description, the software modules 102-1, 102-2, 104-1 and 104-2 are described as if the standard acoustic piano has only one key 21*a* and only one set of damper 21*f*/hammer 21*c* for the only one key 21*a* for the sake of simplicity.

The tone signal is generated through a signal synthesizing processing in the tone signal synthesizing system 100, and the signal synthesizing process is carried out on the basis a physical model where two wires form the wire or wires 21*e* associated with each key. The two string model calculating modules 104-1 and 104-2 are connected in parallel to the instrument body model calculating module 105, and are in charge of the two wires, respectively. Similarly, the two damper model calculating modules 102-1 and 102-2 are respectively provided for the two wires, and are connected to the two string model calculating modules 104-1 and 1042, respectively. In case where a tone signal synthesizing system is prepared on the basis of a physical model containing three wires or more than three wires for each key, the string model calculating modules 104-*iw* and damper model calculating modules 102-*iw* are increased in such a manner that the number of wires iw is equal to the number iw of string model calculating modules and the number iw of damper model calculating modules. If the number iw of wires is 3 or 4, the number iw of string model calculating modules and the number iw of damper model calculating modules are also 3 or 4.

Four input signals $e_k(n\Delta t)$, $e_p(n\Delta t)$, $v_H(n\Delta t)$ and $e_s(n\Delta t)$ are prepared in the controller 11, and are supplied to the tone signal synthesizing system 100. The first input signal $e_k(n\Delta t)$ is representative of a piece of key stroke data expressing stroke of the key, and the second input signal $v_H(n\Delta t)$ is representative of the hammer velocity. As described hereinbefore, the hammer velocity is determined on the basis of the key velocity and a key acceleration. The key velocity is measured by means of the key velocity sensor 15*e*, and the piece of key velocity data is reported to the controller 11 through the digital key velocity signal KV. The key acceleration is determined through differentiation on the values of key velocity.

The third input signal $e_p(n\Delta t)$ is representative of the damper pedal stroke, and the fourth input signal $e_s(n\Delta t)$ is representative of the soft pedal stroke. The damper pedal stroke and soft pedal stroke are measured by means of the peal sensors 16*c*, and are reported to the controller 11 through the digital pedal stroke signals PS.

The values of the first to fourth input signals $e_k(n\Delta t)$, $e_p(n\Delta t)$, $v_H(n\Delta t)$ and $e_s(n\Delta t)$ are variable at intervals $\Delta t$. "n" is incremented from zero, 1, 2, . . . , and the lapse of time is expressed as $n\Delta t$. In this instance, the first to fourth input signals $e_k(n\Delta t)$, $e_p(n\Delta t)$, $v_H(n\Delta t)$ and $e_s(n\Delta t)$ are prepared on the basis of the digital signals KS, KV, PS. However, the first to fourth input signals may be prepared on the basis of the tone controlling data.

The tone signal $P(n\Delta t)$ is representative of a piece of tone data, which expresses sound pressure at a certain observation point. The piece of tone data is supplied from the air model calculating module 106 to the sound system 17 for generating the electronic piano tones, and/or are stored in the data storage 12 for playback.

The physical models for the tone synthesizing system 100 are prepared on the following twenty-eight assumptions.

(Assumption 1) The gravity is ignored.

(Assumption 2) While the wires are being stable on the condition that axial force is exerted on the wires in a direction parallel to the centerlines of the wires, the wires are in static equilibrium state, and each of the wires has a thin column configuration, which has a circular cross section.

(Assumption 3) The thickness of wires is not varied so that the beam theory is applicable to the wires.

(Assumption 4) A cross section perpendicular to the centerline of wire keeps itself flat and still perpendicular to the centerline after the deformation. Namely, Bernoulli-Euler's assumption is applied.

(Assumption 5) The amplitude of wires is small in value. However, the amplitude is not always infinitesimal in value.

(Assumption 6) The wires are homogenous.

(Assumption 7) The stress in wires is given as the sum of a component proportional to the strain and another component proportional to the strain rate. In other words, the internal viscous damping, which is same as rigidity proportional viscous damping, takes place in the wires.

(Assumption 8) The external viscous damping, which is same as mass proportional viscous damping, takes place in the wires in directions parallel to the centerlines of wires.

(Assumption 9) The wires are supported at one ends thereof by the bearings 21*eb*, which form parts of the instrument body 21*j*, and at the other ends thereof by the bridges 21 ea, which also form parts of the instrument body 21*j*. The wires are not prohibited at the supported ends thereof from rotation.

(Assumption 10) The action and reaction between the wires and the air are ignored.

(Assumption 11) The hammers 21*c* have their head portions to be brought into collision with the wires, and the head portions have a column shape. The column has circular end surfaces, and the diameter of circular end surfaces is infinitesimal. The column has height, the value of which permits the column to be free from interference with the adjacent wires 21*e*.

(Assumption 12) In case where plural wires are associated with a single hammer 21*c*, the centerlines of wires are on a virtual plane in the static equilibrium.

(Assumption 13) In case where the plural wires are associated with the single hammer 21*c*, the single hammer 21*c* is assumed to have plural hammer heads equal in number to the wires.

(Assumption 14) The centerline of the column is perpendicular to the centerline of associated wire in the static equilibrium.

(Assumption 15) The center of gravity of the hammer 21*c* is moved on a single line.

(Assumption 16) The direction of movement of the center of gravity of hammer 21*c* is perpendicular to the centerline of the column-shaped hammer head and further to the centerline of wire in the static equilibrium.

(Assumption 17) The hammer 21*c* is deformed in a direction consistent with the direction of movement of the center of gravity of hammer 21*c*.

(Assumption 18) A relation between the compressive force on the hammer 21*c* and the amount of compression is given as a function where an exponent is a positive real number.

(Assumption 19) Any friction does not take place between the hammer head of hammer 21*c* and the surface of wire.

(Assumption 20) The action and reaction between the hammer 21*c* and the air are ignored.

(Assumption 21) As to the wires associated with the damper 21*f*, the resistance force of damper 21*f* for restricting the bending vibrations of wires is exerted to certain points on the centerlines of wires, and the certain point is referred to as "tone stoppage point".

(Assumption 22) The resistance-rate relation is expressed as a linear expression.

(Assumption 23) The amplitude of vibrations of instrument body 21*j* is extremely small in value.

(Assumption 24) The instrument body 21*j* approximates to a linear viscous damping system.

(Assumption 25) The reaction of air on the instrument body 21*j* is ignored.

(Assumption 26) The air is homogenous.

(Assumption 27) The relation between the air pressure and volumetric strain is given as a linear expression.

(Assumption 28) Any eddy does not take place in the air.

In the following description, a right-hand coordinate system (x, y, z) is used for the wires. The center line of wire in the static equilibrium is made coincident with the x-axis of the coordinate system, and the supported end of wire at the bearing 21*eb* is disposed at the origin (0, 0, 0) of the coordinate system. The other supported end of wire at the bridge 21*ea* is disposed in the region where x is greater than zero. The center of gravity of hammer 21*c* is moved in a positive direction of z-axis at the collision with the wires. A right-hand coordinate system (X, Y, Z) is used for the instrument body 21*j* and the air. "t" stands for the lapse of time, and is referred to as time variable.

Since the physical models 102-1, 102-2, 103, 104-1, 104-2, 105 and 106 are fabricated on an acoustic piano where the above-described assumptions are realized. For this reason, the component parts of acoustic piano are not labeled with references designating the component parts of standard acoustic piano 21.

Subsequently, description is made on parameters and symbols of the parameters. The parameters are divided into five groups, and are given to the tone signal synthesizing system 100 for data processing on the models. The parameters of group 1 is variable together with time, i.e., time-dependent parameters, and the parameters of groups 2 to 5 are unchanged regardless of the lapse of time, i.e., time-independent parameters.

Group 1: The parameters of group 1 relate to a performance on the electronic piano 1, and are given to the tone signal synthesizing system 100. The terms "key", "wire", "hammer", "damper" and "instrument body" are indicative of the component parts 21*a*, 21*e*, 21*c*, 21*f* and 21*j* of the standard piano on which the physical models are fabricated.

$V_H^{[ik]}(t)$ expresses the hammer velocity immediately before the collision with the wire or wires.

$e_K^{[ik]}(t)$ is a coefficient varied together with the key stroke.

$e_P(t)$ is a coefficient varied together with the pedal stroke of the damper pedal.

$e_S^{[is]}(t)$ is a coefficient varied together with the pedal stroke of the soft pedal.

Group 2: The parameters of group 2 is used in a design work on the electronic piano 1.

$I_W^{[ik]}$ expresses the number of wires, which are associated with the single key.

$I_D^{[ik][iw]}$ expresses the number of dampers associated with the single wire set.

$\theta_H^{[ik]}$ expresses an inclination angle of hammer movement on a virtual plane to which the z-plane is perpendicular and in which the x-axis is contained.

$M_H^{[ik]}$ expresses the mass of the hammer.

$K_H^{[ik][iw]}$ is a positive constant or a main coefficient expressing the resiliency of the hammer.

$p^{[ik][iw]}$ is a positive constant or an exponent expressing the resiliency of the hammer.

$b_D^{[ik][iw]}$ is a viscous damping coefficient of the damper.

$d^{[ik][iw]}$ expresses the diameter of wire.

$\gamma^{[ik][iw]}$ expresses the density of wire in the static equilibrium.

$E^{[ik][iw]}$ expresses the modulus of longitudinal elasticity.

$\eta^{[ik][iw]}$ expresses the internal viscous damping coefficient of wire.

$b^{[ik][iw]}$ expresses the external viscous damping coefficient of wire in the longitudinal direction of wire.

$\alpha_H^{[ik][iw]}$ is a constant expressing a point on the surface of wire where the hammer is brought into collision. The point on the surface of wire is hereinafter referred to as "impact point."

$\alpha_D^{[ik][iw][iD]}$ is a constant expressing the position of the damper at which the tone is decay. The position is hereinafter referred to as "tone decay point."

$Z_B^{[ik][iw][iB]}$ expresses the z-coordinate of the supported ends of wire.

$X_B^{[ik][iw][iB]}$ expresses the x-coordinate of the supported ends of wire.

$Y_B^{[ik][iw][iB]}$ expresses the y-coordinate of the supported ends of wire.

$\omega_C^{[m]}$ expresses the natural angular frequency of the instrument body.

$\zeta_C^{[m]}$ expresses the modal damping ratio.

$\phi_{B1}^{[ik][iw][iB][m]}$ expresses the z component of instrument body at the supported ends of wire in the natural vibration mode.

$\phi_{B2}^{[ik][iw][iB][m]}$ expresses the x component of instrument body at the supported ends of wire in the natural vibration mode.

$\phi_{B3}^{[ik][iw][iB][m]}$ expresses the y component of instrument body at the supported ends of wire in the natural vibration mode.

The natural vibration mode of instrument body is normalized by using the modal mass.

Group 3: The parameter of group 3 relates to an observation point in the air, and is used in the design work.

$\hat{h}^{[ip][m]}(n\Delta t)$ $(n=0, 1 \ldots, N^{[ip]}-1)$ expresses the impulse response between the velocity and the sound pressure at the observation point in the air on the modal coordinate system in the natural vibration mode of the instrument body.

Group 4: The parameter of group 4 relates to the tuning work.

$\epsilon_0^{[ik][iw]}$ expresses the vertical strain of wire in the static equilibrium.

Group 5: The parameters of group 5 relates to numerical calculations.

$M_1^{[ik]}(=M_3^{[ik]})$ is the number of modes of natural vibrations, i.e., natural vibration modes in the bending vibrations of wire.

$M_2^{[ik]}$ is the number of modes of natural vibrations, i.e., natural vibration modes in the longitudinal vibrations of wire.

M is the number of modes of natural vibrations, i.e., natural vibration modes of the instrument body.

$\Delta t$ expresses the intervals of sampling.

$N^{[ip]}$ expresses the length of the impulse response between the velocity and the sound pressure at the observation point in the air on the modal coordinate system in the natural vibration mode of the instrument body.

$W_H$ expresses the value of $w_H^{[ik]}(t)$ when the hammer velocity $V_H^{[ik]}(t)$ is input. The value is a negative real number. $w_H^{[ik]}(t)$ is hereinlater described in conjunction with group 8.

The tone signal is output from the air model calculating module 106, and is representative of the sound pressure at the observation point in the air. The value of sound pressure is expressed as $P^{[ip]}(n\Delta t)$ where n is 0, 1, . . . , and is variable at intervals of $\Delta t$. The value of sound pressure $P^{[ip]}(n\Delta t)$ is a parameter of group 6.

Other parameters, which are required for the calculations on the physical models, are described as groups 7, 8 and 9.

Group 7:

$\iota^{[ik][iw]}$ expresses the length of wire in the static equilibrium, i.e., the distance between the supported ends of wire.

$x_H^{[ik][iw]}$ expresses the x-coordinate of the impact point, and is equal to $\alpha_H^{[ik][iw]}\,\iota^{[ik][iw]}$.

$x_D^{[ik][iw][iD]}$ expresses the x-coordinate of the tone decay point, and is equal to $\alpha_D^{[ik][iw][iD]}\,\iota^{[ik][iw]}$.

$\beta_{kk'}^{[ik][iw]}$ expresses the direction cosine among the coordinate axes where k is 1, 2 and 3 and k' is 1, 2 and 3.

| | z | x | y |
|---|---|---|---|
| Z | $\beta_{11}^{[ik][iw]}$ | $\beta_{12}^{[ik][iw]}$ | $\beta_{13}^{[ik][iw]}$ |
| X | $\beta_{21}^{[ik][iw]}$ | $\beta_{22}^{[ik][iw]}$ | $\beta_{23}^{[ik][iw]}$ |
| Y | $\beta_{31}^{[ik][iw]}$ | $\beta_{32}^{[ik][iw]}$ | $\beta_{33}^{[ik][iw]}$ |

In case where a single wire is assigned to a hammer, $\beta_{kk'}$ is uniquely determined on the condition that $Z_B$, $X_B$, $Y_B$ and $\theta_H$ are given. In case where plural wires are assigned to a hammer, $\beta_{kk'}$ is uniquely determined on the condition that $Z_B$, $X_B$ and $Y_B$ are given.

Group 8:

$w_H^{[ik]}(t)$ expresses displacement of the center of gravity of the hammer.

$w_e^{[ik][iw]}(t)$ expresses the amount of compression of the hammer. The amount of compression is equivalent to the decrement of distance between the hammer head and the center of gravity of hammer.

$f_H^{[ik][iw]}(t)$ expresses the force exerted on the surface of wire by means of the hammer head.

$e_D^{[ik]}(t)$ expresses a damper state factor for the wire varied depending upon state of damper pedal and state of associated key. (See equation 1)

$f_{D1}^{[ik][iw][iD]}(t)$ expresses the resistance force of damper in the z direction.

$f_{D3}^{[ik][iw][iD]}(t)$ expresses the resistance force of damper in the y direction.

$u_1^{[ik][iw]}(x,t)$ expresses the displacement of centerline of wire in the z direction.

$u_2^{[ik][iw]}(x,t)$ expresses the displacement of centerline of wire in the x direction.

$u_3^{[ik][iw]}(x,t)$ expresses the displacement of centerline of wire in the y direction.

$u_{B1}^{[ik][iw][iB]}(t)$ expresses the displacement of wire supporting end in the z direction.

$U_{B2}^{[ik][iw][iB]}(t)$ expresses the displacement of wire supporting end in the x direction in the (x,y,z) coordinate system.

$u_{B3}^{[ik][iw][iB]}(t)$ expresses the displacement of wire supporting end in the y direction.

$U_{B1}^{[ik][iw][iB]}(t)$ expresses the displacement of wire supporting end in the Z direction in (X,Y,Z) coordinate system.

$U_{B2}^{[ik][iw][iB]}(t)$ expresses the displacement of the wire supporting end in the X direction.

$U_{B3}^{[ik][iw][iB]}(t)$ expresses the displacement of the wire supporting end in the Y direction.

$f_{B1}^{[ik][iw][iB]}(t)$ expresses the component force in z direction exerted on the supported end through the wire.

$f_{B2}^{[ik][iw][iB]}(t)$ expresses the component force in x direction exerted on the supported end through the wire.

$f_{B3}^{[ik][iw][iB]}(t)$ expresses the component force in y direction exerted on the supported end through the wire.

$F_{B1}^{[ik][iw][iB]}(t)$ expresses the component force in Z direction exerted on the supporting portion through the wire.

$F_{B2}^{[ik][iw][iB]}(t)$ expresses the component force in X direction exerted on the supporting portion through the wire.

$F_{B3}^{[ik][iw][iB]}(t)$ expresses the component force in Y direction exerted on the supporting portion through the wire.

$\omega_1^{[ik][iw][m1]}$ expresses the natural angular frequency of the bending vibrations of wire, and is equal to $\omega_3^{[ik][iw][m1]}$.

$\omega_2^{[ik][iw][m2]}$ expresses the natural angular frequency of the longitudinal vibrations of wire.

$\zeta_1^{[ik][iw][m1]}$ expresses the modal damping ratio of the bending vibrations of wire, and is equal to $\zeta_3^{[ik][iw][m1]}$.

$\zeta_2^{[ik][iw][m2]}$ expresses the modal damping ratio of longitudinal vibrations of wire.

Group 9:

$A_1^{[ik][iw][m1]}(t)$ expresses the displacement of wire in the z-direction in the natural vibration mode of bending vibrations in the modal coordinate system.

$A_2^{[ik][iw][m2]}(t)$ expresses the displacement of wire in the x-direction in the natural vibration mode of the longitudinal vibrations in the modal coordinate system.

$A_3^{[ik][iw][m3]}(t)$ expresses the displacement of wire in the y-direction in the natural vibration mode of bending vibrations in the modal coordinate system.

$A_C^{[m]}(t)$ expresses the displacement of instrument body in the modal coordinate system for the natural vibration mode.

$P^{[ip]}(t)$ expresses the sound pressure at the observation point in the air.

$V_G^{[iG]}(t)$ expresses the outward normal component of velocity vector for the acoustic radiation element at the center of figure, and is hereinafter simply referred to as "velocity of acoustic radiation element."

$H^{[ip][iG]}(\omega)$ expresses a function of frequency response between the velocity of acoustic radiation element and the sound pressure at the observation point in the air.

$h^{[ip][iG]}(t)$ expresses a function of impulse response between the velocity of acoustic radiation element and the sound pressure at the observation point in the air.

$H'^{[ip][m]}(\omega)$ expresses a function of frequency response between the velocity of instrument body in the modal coordinate system for the natural vibration mode.

$\hat{h}^{[ip][m]}(t)$ expresses a function of impulse response between the velocity of instrument body in the modal coordinate system for the natural vibration mode and the sound pressure at the observation point in the air.

$I_G$ expresses the number of acoustic radiation elements.

$\phi_G^{[iG][m]}$ expresses the outward normal component of acoustic radiation element in the natural vibration mode of instrument body at the center of figure. The natural vibration mode of instrument body is normalized by using the modal mass.

Group 10: Description is made on indexes of the above-described parameters.

$i_K$ expresses the key numbers respectively assigned to the keys, and is varied as 1, 2, . . . $I_K$.

$i_W$ expresses the number assigned to the wires associated with each key, and is varied as 1, 2, . . . , $i_W^{[ik]}$ $i_S$ expresses whether or not the hammer head is brought into collision with the wire. When the hammer head is brought into collision with the wire, $i_S$ is 1. On the other hand, when the hammer head is not brought into collision with the wires, $i_S$ is 2. In case where $I_W$ is equal to or greater than 3 and $i_W$ is $I_W$, $i_S$ is 2. In the other cases, $i_S$ is 1.

$i_D$ expresses the number assigned to the damper associated with each wire, and is varied as 1, 2, . . . $I_D^{[ik][iw]}$.

$i_B$ expresses the number assigned to the supported end of wire. Since the wire is supported at both ends thereof, $i_B$ is zero or 1. When $i_B$ is zero, the supported end is held in contact with the bridge. On the other hand, when $i_B$ is 1, the supported end is held in contact with the bearing.

$i_G$ expresses the number assigned to the acoustic radiation element, and is varied as 1, 2, . . . , $I_G$.

$i_P$ expresses the number assigned to the observation point in the air, and is varied as 1, 2, . . . , $I_P$.

$m_1$, $i_1$ express the number assigned to the natural vibration modes of the bending vibrations of wire, and $m_1$ is varied as 1, 2, . . . , $M_1^{[ik]}$.

$m_2$, $i_2$ express the number assigned to the natural vibration modes of the longitudinal vibrations of wire, and $m_2$ is varied as 1, 2, . . . , $M_2^{[ik]}$.

$m_3$, $i_3$ express the number assigned to the natural vibration modes of the bending vibrations of wire, and $m_1$ is varied as 1, 2, . . . , $M_3^{[ik]}$.

m expresses the number assigned to the natural vibration modes of the instrument body, and is varied as 1, 2, . . . , M.

Description is hereinafter made on data processing carried out through the software modules 101 to 106 in the tone signal synthesizing system 100. In the following description, all of the indexes are not written in equations, but indispensable indexes are written for avoiding complexity. When t is zero, the parameters $e_k(t)$, $e_P(t)$ and $e_S(t)$ take initial values of zero. In other words, the keys 15*b* and 15*c*, damper pedal 16*a* and soft pedal 16*b* initially stay at the rest positions, and the strokes are zero. The other parameters with the index t also take the initial values of zero.

Comparator

The comparator 101 acquires the input signal 1 $e_k(n\Delta t)$ representative of the key stroke and the input signal 3 $e_D(n\Delta t)$ representative of the damper pedal stroke, and compares the input signals 1 $e_k(n\Delta t)$ with the input signal 3 $e_P(n\Delta t)$ to see which has the value less than the value of the other. The comparison result $e_D(t)$ is expresses as $$e_D(t)=\min(e_k(t),e_P(t)) \quad \text{Equation 1}$$

If $e_k(t)$ is equal to 1, the parameter is indicative of state where the key 15*b* or 15*c* is not depressed.

If $e_k(t)$ is equal to a value between zero and 1, i.e., $1 \geqq e_k(t) \geqq 0$, the parameter is indicative of state where the key 15*b* or 15*c* is depressed to a key position on the way to the rest position.

If $e_k(t)$ is equal to zero, the key 15*b* or 15*c* reaches the end position. Although the sign of equation is inserted into the state on the way to the rest position, the sign of equation expresses the mechanical play of dampers.

If the $e_P(t)$ is equal to 1, the parameter is indicative of state where the damper pedal 16*a* is not depressed.

If $e_P(t)$ is equal to a value between zero and 1, i.e., $1 \geqq e_P(t) \geqq 0$, the parameter is indicative of state where the damper pedal 16*a* is depressed to a pedal position on the way of the rest position.

If $e_P(t)$ is equal to zero, the damper pedal 16*a* reaches the end position.

Damper Model Calculating Module

When the comparator 101 determines the answer to the comparison, the comparator 101 supplies an output signal $e_D(n\Delta t)$, which is representative of the parameter having a smaller value, to the damper model calculating modules 102-1 and 102-2. The damper model calculating module 102-1 is in charge of the first wire, i.e., $i_w$ is equal to 1, and the other damper model calculating module 102-2 is in charge of the second wire, i.e., $i_w$ is equal to 2. In case where the wire set has three wires or more, than three wires, the third damper model calculating module with the index $i_w$=3 and other damper model calculating modules with the indexes $i_w$= 4, . . . are assigned to the third wire and other wires as described hereinbefore. If the damper model calculating modules are increased, the string model calculating modules may be also increased, and all of the string model calculating modules are connected to the instrument body model calculating module 105 in parallel.

All of the damper model calculating modules play a same role. For this reason, the suffixes "-1" and "-2" are deleted from the references designating the damper model calculating modules, and the damper model calculating module, which stands for both of the damper model calculating modules 102-1 and 102-2, is labeled with "102".

Although the string model calculating modules 104-1 and 104-2 are respectively connected to the damper model calculating modules 102-1 and 102-2, the string model calculating modules 104-1 and 104-2 play a same role, and, for this reason, the string model calculating module, which stands for both of the string model calculating modules 104-1 and 104-2, is labeled with 104.

The output signal $e_D(n\Delta t)$ and output signal $u_K(x_D, n\Delta t)$ where k=1, 3 are respectively supplied from the comparator 101 and string model calculating module 104 to the damper model calculating module 102. The damper model calculating module 102 carries out data processing for the following calculations on the output signals $e_D(n\Delta t)$ and $u_K(x_D, n\Delta t)$. The result of data processing is output from the damper model calculating module 102 as an output signal $f_{Dk}(n\Delta t)$. The output signal $f_{Dk}(n\Delta t)$ is supplied to the string model calculating module 104.

While the key of standard piano is staying at the rest position, the damper is fully held in contact with the wires, and prohibits the wires from vibrations. While a pianist is depressing the key, the depressed key, which is found on the way to the end position, makes the damper gradually spaced from the wires. Finally, the damper is perfectly spaced from the wires, and becomes free from the resistance of damper. Then, the wires get ready to vibrate. Moreover, the degree of contact between the damper and the wires are varied depending upon the stroke of damper pedal. Thus, the pianist can precisely control the degree of resonance with wires and the tone decay by varying the stroke of damper pedal in the standard piano.

The above-described role of damper is expressed as the following relational expressing between the resistance of damper $f_{Dk}(t)$ and the amount of deformation of damper $u_k(x_D, t)$.

$$f_{Dk}(t)=b_D e_D(t) Du_k(x_D^{[iD]},t) k=1,3 \quad \text{Equation 2}$$

where Dt stands for d/dt.

The output signal $e_D(n\Delta t)$ is supplied from the comparator 101 to the damper model calculating module 102, and the value of output signal $e_D(n\Delta t)$ is substituted for $e_D(t)$ in equation 2. Then, the physical quantity $b_D e_D(n\Delta t)$, which is corresponding to the viscous coefficient of damper, is varied on the discrete time base, i.e., (t=nΔt; n=0, 1, 2, . . . ), and the natural tone decay like the standard piano and the resonance of wires are achieved through the damper model calculating module 102. In other words, the damper model calculating module 104 simulates the continuous tone decay and wire resonance by varying the physical quantity $b_D e_D(n\Delta t)$.

In the actual data processing, equation 2 is introduced into equations of motion, which are hereinlater described as equations 16 and 18, for the modes of wires in the string model calculating module 104.

Hammer Model Calculating Module

The hammer model calculating module 103 acquires the input signal 2 $V_H(n\Delta t)$ and input signal 4 $e_S(n\Delta t)$, and further acquires the output signal $u_1(x_H, n\Delta t)$ from the string model calculating module 104. The hammer model calculating module 103 carries out data processing for calculations described hereinafter, and supplies the result of calculation $f_H(n\Delta t)$ to the string model calculating module 104.

The Newton's equation of motion is applied to the above-described assumptions of physical models. Then, the equation of hammer motion is expressed as $$Dt^2 w_H(t) = -(1/M_H)\sum_{iw=1}^{IW} f_H^{[iw]}(t) \qquad \text{Equation 3}$$

where $Dt^2$ stands for $d^2/dt^2$.

Equation 4 is a relational expression between the force exerted on the surface of wire by the hammer $f_H^{[iw]}(t)$ and the amount of compression of hammer.

$$f_H^{[iw]}(t)=K_H e_S^{[is]}(t)\{w_e^{[iw]}(t)\}^P \qquad \text{Equation 4}$$

If $e_S^{[is]}(t)$ is equal to 1, the soft pedal stays at the rest position.

If $e_S^{[1]}(t)$ is equal to or less than 1 and greater than zero, i.e., $1 \geqq e_S^{[1]}(t) > 0$. the soft pedal is found on the way to the end position.

If $e_S^{[1]}(t)$ is less than 1 and greater than zero, i.e., $1 > e_S^{[1]}(t) > 0$, the soft pedal is perfectly depressed.

If $e_S^{[1]}(t)$ is equal to or less than 1 and equal to or greater than 0, i.e., $1 \geqq e_S^{[2]}(t) \geqq 0$, the soft pedal is found on the way to the end position.

If $e_s^{[2]}(t)$ is equal to zero, the soft pedal is perfectly depressed.

Nevertheless, equation 5 is applied on the condition that the head of hammer is in contact with the surface of wire, and equations 6 and 7 are applied on the condition that the head of hammer is spaced from the surface of wires.

$$w_e(t)=w_H(t)-u_1(x_H,t) \geqq 0 \qquad \text{Equation 5}$$

$$w_e(t)=0 \qquad \text{Equation 6}$$

$$w_H(t)-u_1(x_H,t)<0 \qquad \text{Equation 7}$$

When the right side of equation 3 is expressed as f(t) and the $dw_H(t)/dt$ is written as $v_H(t)$, the ordinary differential equation for the variable t, i.e., equation 3 is solved on the discrete time base t, i.e., $t=n\Delta t$ where n is 1, 2, 3, . . . by using the progressive Euler's formula and the formula of trapezoid as equation 8.

$$v_H(n\Delta t)=v_H((n-1)\Delta t))+\Delta t \cdot f((n-1)\Delta t)$$

$$w_H(n\Delta t)=w_H((n-1)\Delta t)+\Delta t/2)\cdot(v_H(n-1)\Delta t)+v_H(n\Delta t) \qquad \text{Equations 8}$$

When the hammer velocity $V_H((n-1)\Delta t)$ is greater than zero, $V_H((n-1)\Delta t)$, 0 and $W_H$ are respectively substituted for $v_H((n-1)\Delta t))$, $f((n-1)\Delta t)$ and $w_H((n-1)\Delta t)$ of equations 8, then the displacement of the center of gravity of hammer $w_H(n\Delta t)$ is given through the calculation. When the condition of hammer contact, i.e., equation 5 is satisfied, the output $f_H^{[iw]}(n\Delta t)$, which is supplied to the string model calculating module 104, is determined.

When a player depresses the soft pedal of standard piano, the hammers are laterally moved in the direction toward the higher register, and the soft medal mechanism makes the hammers brought into contact with the wires of associated wires at different areas of hammer heads, or makes the hammer heads imperfectly bought into contact with selected one or selected ones of the wires of associated wires for changing the tone color. In the tone signal synthesizing system 100, the hammer model calculating module 103 simulates the tone color control through the soft pedal mechanism by successively varying the physical quantity $K_H es^{[is]}$, which is corresponding to the modulus of elasticity of hammer, on the discrete time base t, i.e., $t=n\Delta t$ where n is 0, 1, 2, . . . .

String Model Calculating Module

The string model calculating module 104 acquires the output of the damper model calculating module 102, i.e., $f_{Dk}(n\Delta t)$ where k=1, 3, the output from the hammer model calculating module 103, i.e., $f_H(n\Delta t)$ and an output $u_{Bk}(n\Delta t)$, where k=1, 2, 3, of the instrument body model calculating module 105. The output $u_{Bk}(n\Delta t)$ will be hereinlater described in detail. The string model calculating module 104 carries out the data processing for the following calculations for producing outputs $F_{Bk}(n\Delta t)$ where k=1, 2, 3, $u_k(x_D, n\Delta t)$ where k=1, 3, and supplies the output $F_{Bk}(n\Delta t)$ to the instrument body model calculating module 105 and the output $u_k(x_D, n\Delta t)$ to the damper model calculating module 102.

Description is hereinafter made on the data processing for the calculations. When the Newton's law of motion is applied to the movements of wires as described in conjunction with the assumptions, the equations of motion of the wires are expressed as $$\left\{\begin{array}{c}\left(1-c_2^2\cdot\frac{\partial^2}{\partial x^2}\right)\frac{\partial^2}{\partial t^2}- \\ c_1^2\left(1+\eta\cdot\frac{\partial}{\partial t}\right)\frac{\partial^2}{\partial x^2}+c_4^2\left(1+\eta\cdot\frac{\partial}{\partial t}\right)\frac{\partial^4}{\partial x^4}\end{array}\right\}u_1(x,t)= \qquad \text{Equation 9}$$

$$(1/\rho)f_H(t)\delta(x-x_H)-(1/\delta)\sum_{iD=1}^{ID} f_{D1}^{[iD]}(t)\delta(x-x_D^{[iD]})$$

$$\left\{\frac{\partial^2}{\partial t^2}+b\cdot\frac{\partial}{\partial t}-c_2^2\left(1+\eta\frac{\partial}{\partial t}\right)\frac{\partial^2}{\partial x^2}\right\}u_2(x,t)= \qquad \text{Equation 10}$$

$$(1/2)c_3^2\left(1+\eta\frac{\partial}{\partial t}\right)\frac{\partial}{\partial x}\left\{\left(\frac{\partial}{\partial x}\cdot u_3(x,t)\right)^2+\left(\frac{\partial}{\partial x}\cdot u_1(x,t)\right)\right\}^2$$

$$\left\{\begin{array}{c}\left(1-c_5^2\cdot\frac{\partial^2}{\partial x^2}\right)\frac{\partial^2}{\partial t^2}- \\ c_1^2\left(1+\eta\cdot\frac{\partial}{\partial t}\right)\frac{\partial^2}{\partial x^2}+c_4^2\left(1+\eta\cdot\frac{\partial}{\partial t}\right)\frac{\partial^4}{\partial x^4}\end{array}\right\}u_3(x,t)= \qquad \text{Equation 11}$$

$$-(1/\delta)\sum_{iD=1}^{ID} f_{D3}^{[iD]}(t)\delta(x-x_D^{[iD]})$$

where $\rho=\gamma S$, $c_1^2=(E/\gamma)\cdot\varepsilon_0$, $c_2^2=E/\gamma$, $c_3^2=(E/\gamma)\cdot(1-\varepsilon_0)$, $c_4^2=(EI)/(\gamma S')$, $c_5^2=(I/S')$, $S=(\pi/4)d^2$, $I=(\pi/64)d^4$, $\delta$ is *Dirac'* delta function The boundary conditions of wires are expressed as equations 12 and 13.

$$u_k(0,t)=u_{Bk}^{[iB]}(t)|_{iB=1}k=1,2,3$$

$$\partial^2/\partial x^2\cdot u_k(0,t)=0k=1,3 \qquad \text{Equations 12}$$

$$u_k(\iota,t)=u_{Bk}^{[iB]}(t)|_{iB=0}k=1,2,3$$

$$\partial^2/\partial x^2\cdot u_k(\iota,t)=0k=1,3 \qquad \text{Equations 13}$$

Conventionally, a solution of a wire, which is simply supported at both ends thereof, in transient state vibrations is disclosed by D. E. Hall in "Piano Wire Excitation", VI "Nonlinear modeling", J. Acoust. Soc. Am, vol. 92, No. 1, pp. 95-105, 1992. The "simply supported ends" mean that that the supported ends of wire do not move. In the solution, the "displacement of wire" is expressed by Fourier sinusoidal series having a certain time function as a coefficient, and equation 14 expresses the relation.

$$u_k(x,t)=\sum_{mk=1}^{Mk}A_k^{[mk]}(t)\sin(m_k\pi x/\iota)\quad k=1,2,3 \qquad \text{Equation 14}$$

The sinusoidal function of equation 14 expresses a natural vibration mode of wire on the condition that the boundary condition is the simply supported ends. If the supported ends are moved as those of the wires of standard piano, it is not easy to determine the natural vibration mode of wire, and a spatial discrete expression such as that through the finite element method or difference calculus is required. Although the spatial function and the time function are not separated in those solving methods, they are separated in the solving method using the natural vibration mode. For this reason, those methods make errors in the numerical calculation tend to be accumulated on the time base rather than the solving method using the natural vibration mode. Thus, the present invention thinks it difficult accurately to synthesize tones generated for a long time through those methods.

In order accurately to solve the problem in the transient state vibrations of wire with the movable supported ends at high speed, the present inventor proposes to express the displacement of wire as the sum of Fourier sinusoidal series having a certain time function as a coefficient and displacement of line drawn between the two supported ends as equation 15.

$$u_k(x,t)=\sum_{mk=1}^{Mk}A_k^{[mk]}(t)\sin(m_k\pi x)/\iota+(x/\iota)u_{Bk}^{[iB]}(t)|_{iB=0}+\{(\iota-x)/\iota\}u_{Bk}^{[iB]}(t)|_{iB=1} \qquad \text{Equation 15}$$

$k=1,2,3$

Equation 15 makes the boundary condition expressions equations 12 and 13 satisfied at any t. Although the sinusoidal function of equation 15 does not express the natural vibration mode in the strict sense of words, the sinusoidal function is assumed to express the natural vibration mode for convenience's sake.

Equation 15 is introduced into partial differential equations 9, 10 and 11, thereafter, are multiplied by $\sin(i_k\pi x/1)$ where $i_k=1,2,\ldots,Mk$; $k=1,2,3$, and are integrated for the interval $0\geqq x\geqq 1$. Then, the following ordinary differential equations 16, 17 and 18 are obtained.

$$\{Dt^2+2\zeta_1^{[i1]}\omega_1^{[i1]}Dt+(\omega_1^{[i1]})^2\}A_1^{[i1]}(t)=Dt^2\left\{\sum_{iB=0}^{1}\upsilon_{B1}^{[iB][i1]}u_{B1}^{[iB]}(t)\right\}+\upsilon_H^{[i1]}f_H(t)-\sum_{iD=1}^{ID}\upsilon_{D1}^{[iD][i1]}f_{D1}^{[iD]}(t) \qquad \text{Equation 16}$$

$i_1=1,2,\ldots,M_1$

-continued $$\{Dt^2+2\zeta_2^{[i2]}\omega_2^{[i2]}Dt+(\omega_2^{[i2]})^2\}A_2^{[i2]}(t)=(Dt^2+bDt)\left\{\sum_{iB=0}^{1}\upsilon_{B2}^{[iB][i2]}u_{B2}^{[iB]}(t)\right\}-c_3^2\cdot 1/\iota\cdot(\pi/\iota)^3 i_2(1+\eta Dt)\left\{\sum_{m3=1}^{M3}\sum_{m3=1}^{M3}\right\}m_3m_3'\Gamma m_3m_3'i_2A_3^{[m3]}(t)A_3^{[m'3]}(t)+\left\{\sum_{m1=1}^{M1}\sum_{m'1=1}^{M1}\right\}m_1m_1'\Gamma m_1m_1'i_2A_1^{[m1]}(t)A_1^{[m'1]}(t)\} \qquad \text{Equation 17}$$

$i_2=1,2,\ldots,M_2$ $$\{Dt^2+2\zeta_3^{[i3]}\omega_3^{[i3]}Dt+(\omega_3^{[i3]})^2\}A_3^{[i3]}(t)=Dt^2\left\{\sum_{iB=0}^{1}\upsilon_{B3}^{[iB][i3]}u_{B3}^{[iB]}(t)\right\}-\sum_{iD=1}^{ID}\upsilon_{D3}^{[iD][i3]}f_{D3}^{[iD]}(t) \qquad \text{Equation 18}$$

$i_3=1,2,\ldots,M_3$ where $Dt^2$ and $Dt$ stand for $\frac{d2}{dt2}$ and $\frac{d}{dt}$, respectively.

The variables of equations 16, 17 and 18 are expressed as $$\omega_k^{[ik]}=\left\{\frac{(i_k\pi c_1)}{\iota}\right\}\sqrt{\left\{1+\left(\frac{c_4}{c_1}\right)^2\left(\frac{(i_k\pi)}{\iota}\right)^2\right\}}\Big/\left\{1+c_5^2\left(\frac{(i_k\pi)}{\iota}\right)^2\right\} \qquad \text{Equation 19}$$

$k=1,3$ $$\omega_2^{[i2]}=(i_2\pi c_2)/\iota \qquad \text{Equation 20}$$

$$\zeta_k^{[ik]}=\eta\omega_k^{[ik]}/2 \qquad \text{Equation 21}$$

$k=1,3$ $$\zeta_2^{[i2]}=(b/\omega_2^{[i2]}+\eta\omega_2^{[i2]})/2 \qquad \text{Equation 22}$$

$$\upsilon_{Bk}^{[iB][jk]}=(2/i_k\pi)(-1)^{(1-iB)ik+iB}\Big/\{1+c_5^2(i_k\pi/\iota)^2\} \qquad \text{Equation 23}$$

$k=1,3$ $$\upsilon_{B2}^{[iB][i2]}=(2/i_2\pi)(-1)^{(1-iB)i2+iB} \qquad \text{Equation 24}$$

$$\upsilon_H^{[i1]}=2\sin(i_1\pi\alpha_H)\Big/\left[\rho\iota\{1+c_5^2((i_1\pi)/\iota)^2\}\right] \qquad \text{Equation 25}$$

$$\upsilon_{Dk}^{[iD][ik]}=2\sin(i_k\pi\alpha_D^{[iD]})\Big/\left[\rho\iota\{1+c_5^2((i_k\pi)/\iota)^2\}\right] \qquad \text{Equation 26}$$

$k=1,3$ $$\Gamma_{mkm'ki2}=\int_0^{\iota}\cos\left(\frac{(m_k\pi x)}{\iota}\right)\cos\left(\frac{(m_k'\pi x)}{\iota}\right)\cos\left(\frac{(i_2\pi x)}{\iota}\right)dx \qquad \text{Equation 27}$$

$k=1,3$

The equations of motion for each mode of wire, i.e., equations 16, 17 and 18 are described as the parallelized second-order IIR (Infinite Impulse Response) filters, which are equal in number to $I_k\times I_w^{[ik]}\times(2\times M_1^{[ik]}+M_2^{[ik]})$ where ik=1, 2, . . . , Ik), by means of a bilinear s-z transform, and it is possible successively to determine values of $(A_k^{[ik][iw][mk]}(n\Delta t))$, where $i_k$ is $1,2,\ldots,I_k$; $i_w$ is $1,2,\ldots I_w^{[ik]}$; $m_k$ is $1,2,\ldots,M_k^{[ik]}$ and k is 1, 2, 3, on the time base, i.e., $t=n\Delta t$ (n=0, 1, 2, . . . ) In the calculations, the calculations through equations 16 and 18 are calculated prior to the calculation through equation 17 at each time step, and the non-linear term in the right side of equation 17, i.e., $(A_k^{[mk]}(t)A_k^{[m'k]}(t))$ where k=1, 3, is handled as if it is an term expressing an external force.

Relation between force, which is exerted on the supported ends of wire by the wire, and the displacement of supported ends is expressed as equations 28 and 29.

$$f_{Bk}^{[iB]}(t) = (-1)^{iB}\begin{bmatrix} -c'_1(1+\eta Dt)\frac{\partial}{\partial x}\cdot u_k((1-i_B)\iota, t) + \\ (c')_4(1+\eta Dt)\frac{\partial^3}{\partial x^3}\cdot u_k((1-i_B)\iota, t)\end{bmatrix} \quad \text{Equation 28}$$

where $Dt$ stands for $\frac{d}{dt}$, $i_B = 0, 1$ and $k = 1, 3$.

$$f_{B2}^{[iB]}(t) = (-1)^{iB}\left[-c'_2(1+\eta Dt)\frac{\partial}{\partial x}\cdot u_2((1-i_B)\iota, t)\right. \quad \text{Equation 29}$$

where $Dt$ stands for $\frac{d}{dt}$ and $i_B = 0, 1$.

In equations 28 and 29, $c'_1$=ES $\epsilon_0$, $c'_2$=ES and $c'_4$=EI.

Relation expressed in equation 15 is introduced into equations 28 and 29 so that equations 30 and 31 are obtained.

$$f_{Bk}^{[iB]}(t) = (-1)^{iB}\begin{bmatrix} -c'_1(1+\eta Dt)\left\{\begin{matrix}\sum_{mk=1}^{Mk} A_k^{[mk]}(t)\left(\frac{(m_k\pi)}{\iota}\right)(-1)^{(1-iB)mk} + \\ (1/\iota)\sum_{i'B=0}^{1}(-1)^{i'B}u_{Bk}^{[i'B]}(t)\end{matrix}\right\} - \\ c'_4(1+\eta Dt)\left\{\sum_{mk=1}^{Mk} A_k^{[mk]}(t)\left(\frac{(m_k\pi)}{\iota}\right)^3(-1)^{(1-iB)mk}\right\}\end{bmatrix} \quad \text{Equation 30}$$

where $Dt$ stands for $\frac{d}{dt}$, $i_B = 0, 1$ and $k = 1, 3$.

$$f_{B2}^{[iB]}(t) = (-1)^{iB}\left[-c'_2(1+\eta Dt)\left\{\begin{matrix}\sum_{m2=1}^{M2} A_2^{[m2]}(t)((m_2\pi)/\iota)(-1)^{(1-iB)m2} + \\ (1/\iota)\sum_{i'B=0}^{1}(-1)^{i'B}u_{B2}^{[i'B]}(t)\end{matrix}\right\}\right] \quad \text{Equation 31}$$

where $Dt$ stands for $\frac{d}{dt}$ and $i_B = 0, 1$.

Equation 32 expresses a transforming expression between the instrument body—physical coordinate system for wire.

$$F_{Bk}^{[iB]}(t) = \sum_{k'=1}^{3} f_{Bk'}^{[iB]}(t)\beta_{kk'} \quad \text{Equation 32}$$

where $i_B = 0, 1$ and $k = 1, 2, 3$.

The relations expressed by equations 30 and 31 are introduced into equation 32, and the value of $A_k^{[mk]}(n\Delta t)$ ($m_k$=1, 2, . . . $M_k$; k=1, 2, 3) is substituted for the corresponding factor of the resultant equation. Then, the amount of force $F_{Bk}^{[iB]}(n\Delta t)$, which is exerted on the supported ends by wire, is determined, and is the output from the string model calculating module 104 to the instrument body model calculating module 105.

Equations 33 and 34 are obtained from equation 15.

$$u_1(x_H, t) = \sum_{m1=1}^{M1} A_1^{[m1]}(t)\sin(m_1\pi\alpha_H) + \alpha_H u_{B1}^{[iB]}(t)|_{iB=0} + (1-\alpha_H)u_{B1}^{[iB]}(t)|_{iB=1} \quad \text{Equation 33}$$

-continued $$u_k(x_D^{[iD]}, t) = \sum_{mk=1}^{Mk} A_k^{[mk]}(t)\sin(m_k\pi\alpha_D^{[iD]}) + \alpha_D^{[iD]}u_{Bk}^{[iB]}(t)|_{iB=0} + (1-\alpha_D^{[iD]})u_{Bk}^{[iB]}(t)|_{iB=1} \quad \text{Equation 34}$$

where $k = 1, 3, \ldots$

The displacement of impact point and the displacement of tone decay point are determined by substituting $A_k^{[mk]}(n\Delta t)$ ($m_k$=1, 2, . . . , $M_k$; k=1, 2, 3) for the corresponding factor in equation 15.

The result $u_1(x_H, n\Delta t)$ of equation 33 is output to the hammer model calculating module 103, and is substituted for the corresponding factor of equation 5, again. On the other hand, the result $u_k(x_D^{[iD]}, n\Delta t)$ of equation 34 is output to the damper model calculating module 102, and is recursively given to equations 16 and 18 in the string model calculating module 104 through equation 2 of the damper model calculating module 102.

Instrument Body Model Calculating Module

The instrument body model calculating module 105 acquires $F_{Bk}(n\Delta t)$ from the string model calculating module 104, and a result $A_c(n\Delta t)$ is output from the instrument body model calculating module 105 to the air model calculating module 106.

The motion of instrument body is described as an ordinary differential equation for each mode, and the output $F_{Bk}^{[ik][iw][iB]}(t)$ ($i_k$=1, 2, . . . , $I_k$; $i_w$=1, 2, . . . , $I_w^{[ik]}$; $i_B$=0, 1; k=1, 2, 3) of the string model calculating module 104 is given to the ordinary differential equations. The ordinary differential equation is expressed as $$\{Dt^2 + 2\zeta_c^{[m]}\omega_c^{[m]}Dt + (\omega_c^{[m]})^2\}A_c^{[m]}(t) = \sum_{ik=1}^{Ik}\sum_{iw=1}^{Iw^{[ik]}}\sum_{iB=0}^{1}\sum_{k=1}^{3} F_{Bk}^{[ik][iw][iB]}(t)\phi_{Bk}^{[ik][iw][iB][m]} \quad \text{Equation 35}$$

where $Dt^2$ and $Dt$ stand for $\frac{d^2}{dt^2}$ and $\frac{d}{dt}$, $m = 1, 2, \ldots M$.

The instrument body of acoustic piano is fabricated from wooden component parts and metallic component parts. The wooden component parts make the high-frequency components of vibrations decayed more rapidly rather than the low-frequency components of vibrations. For this reason, listeners feel the acoustic tones generated through the acoustic piano and other instruments fabricated from wooden component parts comfortable and warm for ears. The acoustic characteristics are derived from a physical model of wood, i.e., "material three-dimensionally anisotropic in both of the modulus of elasticity and structural damping coefficient". (See Advanced Composite Material, edited by Japan Society of Mechanics and published by Gihodo Publishing Company, pages 68 to 70.

The instrument body contains component parts made of the material three-dimensionally anisotropic in both of the modulus of elasticity and structural damping coefficient so as to be categorized in a general structural damping system, which is sometimes referred to as a non-proportional structural damping system or a general hysteresis damping system. For this reason, it is impossible to diagonalize the damping matrix through a real characteristic value analysis. (See "Mode Analysis" by Akio Nagamatsu, Baifukann, 1985.) In this instance, the non-diagonalization of damping matrix is ignored, and the physical model is approximated to a proportional structural damping system or a proportional hysteresis system.

Moreover, the proportional structural damping system is approximated to a proportional viscous damping system. For this reason, the modal damping ratio is expressed as (modal structural damping coefficient/2). Then, the natural angular frequency, modal damping ratio and natural vibration mode, which are contained in equation 35, are determined for the instrument body with an arbitrary three-dimensional configuration through a real characteristic value analysis, which is offered in the form of a commercially available computer program for a finite element analysis method. Although the "modal damping ratio" is to be said as—an approximated modal damping ratio—, the term "modal damping ratio" is hereinafter used for the sake of simplicity.

The equation of motion in each mode of the instrument body, which is expressed by equation 35, is described as parallelized second order IIR filters equal in number to M by means of the bilinear s-z transform, and values of $A_c^{[m]}(n\Delta t)$= 1, 2, . . . , M) are successively determined for each mode on the discrete time base t, i.e., t=nΔt (n=0, 1, 2, . . . ), and the result is output to the air model calculating module 106.

The displacement of supported ends is determined by substituting the above-obtained values of c (m=1, 2, . . . , M) into a wire-physical coordinate transformer expressed as equation 37 through a physical coordinate-mode coordinate transformer expressed as equation 36.

$$U_{Bk}^{[iB]}(t) = \sum_{m=1}^{M} A_c^{[m]}(t)\phi_{Bk}^{[iB][m]} \quad \text{Equation 36}$$

where $i_B = 0, 1$ and $k = 1, 2, 3, \ldots$ $$u_{Bk}^{[iB]}(t) = \sum_{k'=1}^{3} U_{Bk'}^{[iB]}(t)\beta_{k'k} \quad \text{Equation 37}$$

where $i_B = 0, 1$ and $k = 1, 2, 3, \ldots$

The calculation result $u_{Bk}^{[iB]}(n\Delta t)$ is output to the string model calculating module 104, and is recursively given to equations 16, 17 and 18 and equations 30, 31, 33 and 34.

Air Model Calculating Module

The air model calculating module 106 acquires $A_c^{[m]}(n\Delta t)$ from the instrument body model calculating module 105, and determines P(nΔt) through the following calculations.

While an arbitrary three-dimensional structure is radiating sound to the air, non-steady sound pressure is observed at an observation point in the air. The entire surface of the structure is divided into miniature acoustic radiation elements, i.e., boundary elements, and the non-steady sound pressure is conventionally given as the total of the results of convoluting integration for all the miniature acoustic radiation elements as indicated by equation 38. The convoluting integration is carried out for each element on "the impulse response between the velocity of each acoustic radiation element of the structure and the sound pressure at the observation point in the air" and "the velocity of each acoustic radiation element of the structure".

$$P^{[ip]}(t) = \sum_{iG=1}^{IG} \int_0^t h^{[ip][iG]}(\tau)V_G^{[iG]}(t-\tau)d\tau \quad \text{Equation 38}$$

However, the number of acoustic radiation elements $I_G$ for high-quality electronic piano tones is too many to complete the calculation on equation 38 within a reasonable time period. In order to cope with the problem due to the many acoustic radiation elements $I_G$, factors given by equations 39 and 40 are substituted for the corresponding factors so as to change the order of calculations between the calculation to determine the total sum in the M natural vibration modes and the calculation to determine the total sum on the acoustic radiation elements $I_G$. As a result, the air model calculating module 106 carries out a calculation of equation 41.

$$V_G^{[iG]}(t) = \sum_{m=1}^{M} DtA_C^{[m]}(t)\phi_G^{[iG][m]} \quad \text{Equation 39}$$

where $Dt$ is $\frac{d}{dt}$.

$$h^{[ip][iG]}(t) = (1/2\pi)\int_{-\infty}^{\infty} H^{[ip][iG]}(\omega)e^{j\omega t}d\omega \quad \text{Equation 40}$$

where $j$ is the imaginary unit and $\omega$ is angular frequency.

$$P^{[ip]}(t) = \sum_{m=1}^{M} \int_0^t \hat{h}^{[ip][m]}(\tau)D_\tau A_C^{[m]}(t-\tau)d\tau \quad \text{Equation 41}$$

where $D_\tau$ is $\frac{d}{d\tau}$.

In equation 41, $\hat{h}^{[ip][n]}(t)$ is given as $$\hat{h}^{[ip][n]}(t)=(1/2\pi)\int_{-\infty}^{\infty} H'^{[ip][n]}(\omega)e^{j\omega t}d\omega \quad \text{Equation 42}$$

In equation 42, $H'^{[ip][m]}(\omega)$ is given as $$H'^{[ip][m]}(\omega) = \sum_{iG=1}^{IG} H^{[ip][iG]}(\omega)\phi_G^{[iG][m]} \quad \text{Equation 43}$$

The natural vibration mode number M, which is required for the synthesis of high-quality electronic piano tones, is much less than the number of acoustic radiation elements $I_G$ so that it is desirable to use equation 41 instead of equation 38.

It is possible to reduce the calculating time required for the electronic piano tones through a previously carried-out calculation of "the impulse response between the velocity of each natural vibration mode in the mode coordinate system and the sound pressure at the observation point in the air", which is expressed as an equation where (t) in the left side of equation 42 is replaced with "nΔt" (n=0, 1, . . . , $N^{[iP]}-1$) instead of the "impulse response between the velocity of each acoustic radiation element of instrument body and the sound pressure at the observation point in the air", which is expressed as an equation where (t) in the left side of equation 40 is replaced with "nΔt" (n=0, 1, . . . , $N^{[iP]}$).

$H^{[ip][iG]}(\omega)$ in equation 43 expresses "a frequency response function between the velocity of each acoustic radiation element of the instrument body and the sound pressure at the observation point in the air", and is determined through the frequency response analysis on a discrete frequency axis for the instrument body with an arbitrary three-dimensional configuration by using a commercially available computer program for a boundary element method. It is possible to determine the value of equation 42 through a general IFFT (Inverse Fast Fourier Transform) calculation.

The differential coefficient of equation 41 expresses the "velocity of instrument body in each natural vibration mode in the mode coordinate system", and is numerically determined through the differentiation of the "displacement of instrument body in each natural vibration mode in the mode coordinate system", i.e., the output $A_C^{[m]}(n\Delta t)$ (m=1, 2, . . . , M)) of the instrument body model calculating module. The integration in equation 41 is determined through the conventional method of FIR (Finite Impulse Response) filter.

Thus, the air model calculating module 106 successively determines the value of tone signal through equation 41 as an output $P^{[ip]}(n\Delta t)$ thereof, and the output of air model calculating module 106 expresses the sound pressure on the time base t, i.e., t=nΔt (n=0, 1, 2, . . . ).

It is possible to make the convoluting calculation speedup by carrying out it in the frequency region, but not in the time region. The speedup method is achieved by a high-speed convolution, in which a fast Fourier transform is used.

As described hereinbefore, the tone signal is generated through the tone signal synthesizing system 100, and is supplied to the sound system 17 so as to make the sound system 17 to produce the electronic piano tones. The electronic piano tones have rich stereophonic reverberations, which are close to the acoustic piano tones generated through the three-dimensional vibrations of the entire instrument body, and ringing sound, which are close to the ringing sound generated through the strong impact on the wires in the middle and lower registers of acoustic piano, and it is possible selectively to give a wide variety of nuances, which are given to the acoustic piano tones by controlling the strokes of pedals of acoustic piano, to the electronic piano tones.

In more detail, the ratio of ringing sound of the electronic piano tone is controllable by changing a parameter, which expresses the length of wires, i.e., the distance between the supported ends of wires, and another parameter, which expresses the ratio of the wire length to the length between the impact point and the supported end at the bearings.

Description is hereinafter focused on the ringing sound with reference to equation 17. However, equation 17 is complicated. In order to make the phenomena more understandable, the displacement at the supported ends, displacement of wire in the y-direction and internal viscous damping coefficient are deleted from equation 17. Equation 17 is rewritten as $$\left\{Dt^2 + 2\zeta_2^{[i2]}\omega_2^{[i2]}Dt + (\omega_2^{[i2]})^2\right\}A_2^{[i2]}(t) = -c_3^2(1/\iota)(\pi/\iota)\,{}^3\hat{t}^2\left\{\sum_{m1=1}^{M1}\sum_{m'=1}^{M1} m_1 m_1'\Gamma_{m1m'1i2}A_1^{[m1]}(t)A_1^{[m'1]}(t)\right\} \quad \text{Equation 44}$$

where $Dt^2$ and $Dt$ stand for $\frac{d^2}{dt^2}$ and $\frac{d}{dt}$, and $i_2 = 1, 2, \ldots, M_2$.

Equation 44 expresses the equation of motion for the $i^2$—order natural vibrations of the longitudinal vibrations of wire. If the right side is seemed to express periodic external force, it is possible to consider equation 44 to be an equation of motion for single-degree-of-freedom viscous damping forced vibrations. As well known to persons skilled in the art, the general solution of the equation of motion is given as the sum of the solution of free vibrations, i.e., a general solution of homogenous equation and the solution of continuous forced vibrations, i.e., a particular solution of non-homogenous equation. The solution of forced vibrations has a feature, in which the system vibrates at the frequency of the periodic external force, and another feature, in which the amplitude is widened under the condition that the frequency of system gets closer and closer to the natural vibration frequency of the system. When the frequency of system becomes equal to the natural vibration frequency, resonance takes place.

Each of the natural vibrations in the bending vibrations of wire is assumed to be categorized in the harmonic vibrations as expressed in equations 45.

$$A_1^{[m1]}(t)=a_1^{[m1]}\sin 2\pi f_1^{[m1]}t, A_1^{[m'1]}(t)=a_1^{[m'1]}\sin 2\pi f_1^{[m'1]}t \quad \text{Equations 45}$$

where $a_1^{[m1]}$ and $a_1^{[m'1]}$ are constants, and $f_1^{[m1]}$ and $f_1^{[m'1]}$ are frequencies of the bending vibrations of wire in the z-direction.

The right side of equation 44 is led to equation 46.

$$\sum_{m1=1}^{M1}\sum_{m'1=1}^{M1} m_1 m_1'\Gamma_{m1m'1i2}A_1^{[m1]}(t)A_1^{[m'1]}(t)\} = (\iota/4)\sum_{m1=1}^{M1-i2} m_1(m_1+i_2)a_1^{[m1]}a_1^{[m1+i2]}\left\{\begin{matrix}\cos 2\pi(f_1^{[m1]}-f_1^{[m1+i2]})t - \\ \cos 2\pi(f_1^{[m1]}+f_1^{[m1+i2]})t\end{matrix}\right\} + (\iota/8)\sum_{m1=1}^{i2-1} m_1(i_2-m_1)a_1^{[m1]}a_1^{[i2-m1]}\left\{\begin{matrix}\cos 2\pi(f_1^{[m1]}-f_1^{[i2-m1]})t - \\ \cos 2\pi(f_1^{[m1]}+f_1^{[i2-m1]})t\end{matrix}\right\} \quad \text{Equation 46}$$

where $i_2 = 1, 2, \ldots, M_2$.

As to equation 46, $i_2$ is fixed. Let's focus attention on the series expressed by the term $\cos 2\pi(f_1^{[m1]}+f_1^{[m1+i2]})t$, and we determine the deviation of the series from the frequency of harmonic series of the $(2\,m_1+i_2)^{th}$-order frequency $f_1^{[m1]}+f_1^{[m1+i2]}$. If the $i_2$ has a small value, it is confirmed that the value of deviation is a quarter of the "deviation from the frequency of harmonic series of the $(2\,m_1+i_2)^{th}$-order natural frequency $f_1^{[2m1+i2]}$ of the bending vibrations. It has been known through the analysis on the acoustic piano tones that "a partial tone series contains a subordinate series deviated in frequency from the harmonic series by a quarter of the principle series." From the knowledge, the series expressed by the above-described term is applicable to the subordinate series. If $i_2$ has large value, the amount of deviation is increased together with $i_2$.

Moreover, a series expressed by the term $\cos 2\pi(f_1^{[m1]}+f_1^{[i2-m1]})t$ also participates into the formation of the subordinate series. However, the series less contributes to the formation of subordinate series rather than the series expressed by the term $\cos 2\pi(f_1^{[m1]}+f_1^{[m1+i2]})t$.

When equation 46 is substituted for the corresponding term of equation 44, the resultant equation expresses that the resonance takes place on the condition that the $(2\ m_1+i_2)^{th}$-order frequency $f_1^{[m1]}+f_1^{[m1+i2]}$ of the subordinate series is consistent with the $i_2$-order natural frequency of the longitudinal vibrations of wire. This phenomenon is inherent in the piano tones generated through an acoustic piano. In addition to the piece of knowledge that "a partial tone series contains a subordinate series deviated in frequency from the harmonic series by a quarter of the principle series", there is another piece of knowledge that "the ringing sound takes place through increase of the energy level of the partial tones in the subordinate series on the condition that the frequency of odd-order partial tones in the subordinate series is consistent with the natural frequency of odd-order vibrations of longitudinal vibrations of wire or that the frequency of even-order partial tones in the subordinate series is consistent with the natural frequency of even-order vibrations of longitudinal vibrations of wire." The expression of the piece of knowledge is rewritten to another analytical expression that "the ringing sound takes place on the condition that the sum of odd-order natural vibration frequency and even-order natural vibration frequency of the bending vibrations of wire is consistent with the odd-order natural vibration frequency of longitudinal vibrations of wire or that the sum of a set of odd-number natural vibration frequencies of bending vibrations of wire or the sum of a set of even-order natural vibration frequencies is consistent with the even-order natural vibration frequency of longitudinal vibrations of wire." (See "Longitudinal Model in Piano Wires" by J. Ellis, Results of New Research Piano Technicians Journal, pages 16 to 23, May 1998) The above-described resultant equation mathematically expresses the piece of knowledge hereinbefore rewritten.

It is possible to derive the humming like "jingling" or "tinkling" from a difference in frequency between the $15^{th}$-order of the subordinate series, in which the "$15^{th}$" is determined as 7+8=2×7+1, and the $15^{th}$-order of the subordinate series, in which the "$15^{th}$" is determined as 6+9=2×6+3. By the way, the term $\cos 2\pi(f_1^{[m1]}-f_{1[m1+i2]})t$ and term $\cos 2\pi(f_1^{[m1]}-f_1^{[i2-m1]})t$ exhibit the existence of partial tones slightly higher in frequency than the natural vibration frequency of bending vibrations.

When the material constants are unchanged, the natural vibration frequency of longitudinal vibrations of wire is only dependent on the length of wire as expressed by equation 20. By the way, this relation is not applied to coil wires, each of which is a wire having a copper wire wound on a steel core, for the lower register. As to the thirtieth key to fortieth key in the eighty-eight keys of a standard piano, there is a possibility that the frequency of the $15^{th}$-order of the subordinate series is close to the fundamental frequency of longitudinal vibrations of wire due to the tuning on the wire length. In this situation, it is possible to avoid excess increase of the amount of ringing sound by regulating the ratio of wire length to length between the impact point and supported end at the bearing to 7 or 8.

This is because of the fact that the $15^{th}$-order, i.e., 7+8=2×7+1-order of subordinate series is produced from the seventh-order natural vibrations and the eighth-order natural vibrations. When the ratio of wire length to length between the impact point and supported end at the bearing is adjusted to 7 or 8, the seventh-order or the eighth-order natural vibrations are removed from the bending vibrations, and the $15^{th}$-order is not produced. Although the $15^{th}$-order, which is expressed as 6+9=2×6+3, is still left in the bending vibrations, the remaining $15^{th}$-order does not resonate with the longitudinal vibrations at the fundamental natural vibration frequency.

In the time-frequency analysis on the acoustic piano tones, the peak of the natural vibrations of longitudinal vibrations, which is equivalent to the solution of free vibrations in case where zero is given to the right side of equation 17, is rapidly decayed on the condition that the natural vibrations are inconsistent with the subordinate series, and any peak is not continuously observed. The major reason for the rapid decay is seemed to be the friction at the supported ends. In the string model calculating module 104, the "local external friction at the supported ends" stands for the "external friction dispersed on the entire wire", i.e., the term containing external viscous damping coefficient b of equation 10.

Description is hereinbefore made on the ringing sound generation mechanism and the design parameters for controlling the amount of ringing sound, i.e., the wire length and the ratio of wire length to length between the impact point and supported end at the bearing. Although the acoustic wave radiation capability of longitudinal vibrations of wires is little, the longitudinal vibrations of wire are able to give rise to the ringing sound with the assistance of the above-described non-linear vibration mechanism of wires, i.e., the finite amplitude vibration mechanism, the three-dimensional coupled vibration mechanism between the instrument body and the wires, to which design factors such as a fitting angle of wires to the instrument body and a configuration of bridges relate, and the three-dimensional acoustic radiation mechanism of instrument body, to which the configuration of bridges relates. In the design work, these design factors are to be taken into account.

"Improvement of piano tones" means pursuit of entire optimum solution to the complicated system, i.e., piano. Conventionally, the designers pursue the entire optimum solution through a try-and-error method. However, the try-and-error method is less efficient in the field of design work for huge complicated acoustic system such as pianos. This is because of the fact that a lot of design factors and various error factors relate to the piano design work. One of the error factors is the dispersion in properties of natural material, and another error factor is the dispersion in skill of human workers. The present invention makes it possible quantitatively to clarify the cause and effect, i.e., the specification for piano and the piano tones. Therefore, the simulation method of present invention is available for a design simulator. It is possible to simulate supernatural effects of a virtual system such as an extremely huge piano impossible to build up through the simulation method of present invention.

Second Embodiment

Figure 4:
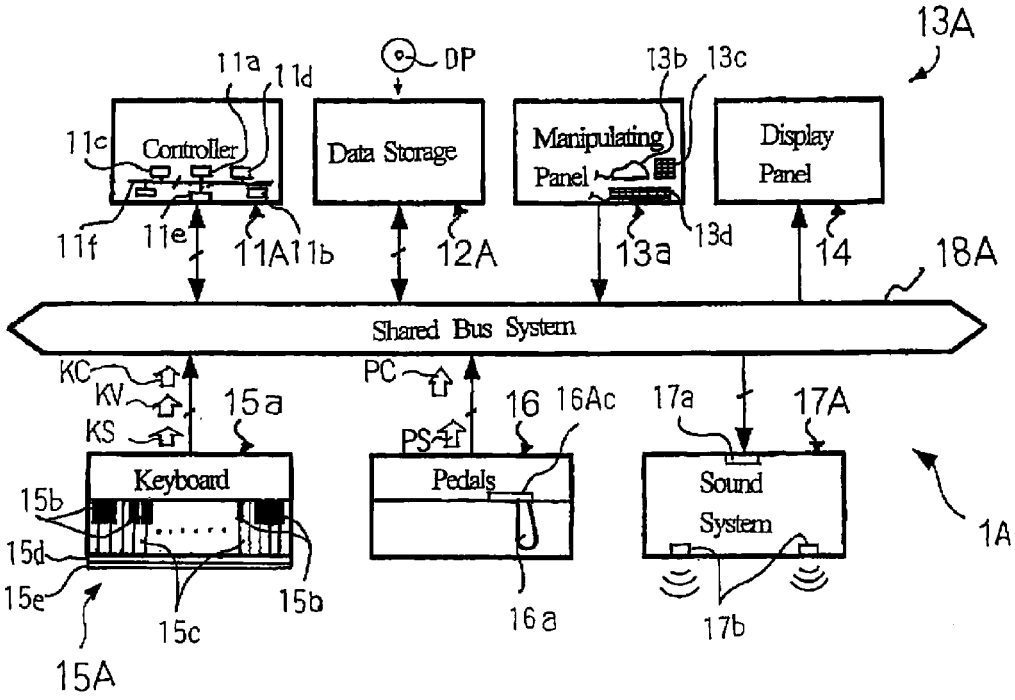
FIG. 4 is a block diagram showing the system configuration of another electronic piano of the present invention.

Turning to FIG. 4, an electronic piano 1A embodying the present invention largely comprises a controller 11A, a data storage 12A, a man-machine interface 13A, manipulators 15A, a sound system 17A and a shared bus system 18A. The man-machine interface 13A, sound system 17A and shared bus system 18A are similar to those 13, 17 and 18 of the electronic piano 1, and, for this reason, component parts of the man-machine interface 13A, sound system 17A and shared bus system 18A are labeled with references designating the corresponding component parts of the man-machine interface 13, sound system 17 and shared bus system 18 without detailed description for the sake of simplicity.

The manipulators 15A are different from the manipulators 15 in that the soft pedal 16*b* is deleted therefrom, and, accordingly, a pedal sensor 16Ac monitors only the damper pedal 16*a*. The other features of manipulators 15A are similar to those of the manipulators 15, and no further description is hereinafter incorporated.

The data storage 12A is different from the data storage 12 in that a piece of control data, which expresses the force exerted on the surface of wire by the hammer $f_H^{[iw]}(t)$, is stored in the read only memory of data storage 12A. The value of piece of control data is indicative of the force when the soft pedal 16*b* stays at the rest position.

Figure 5:
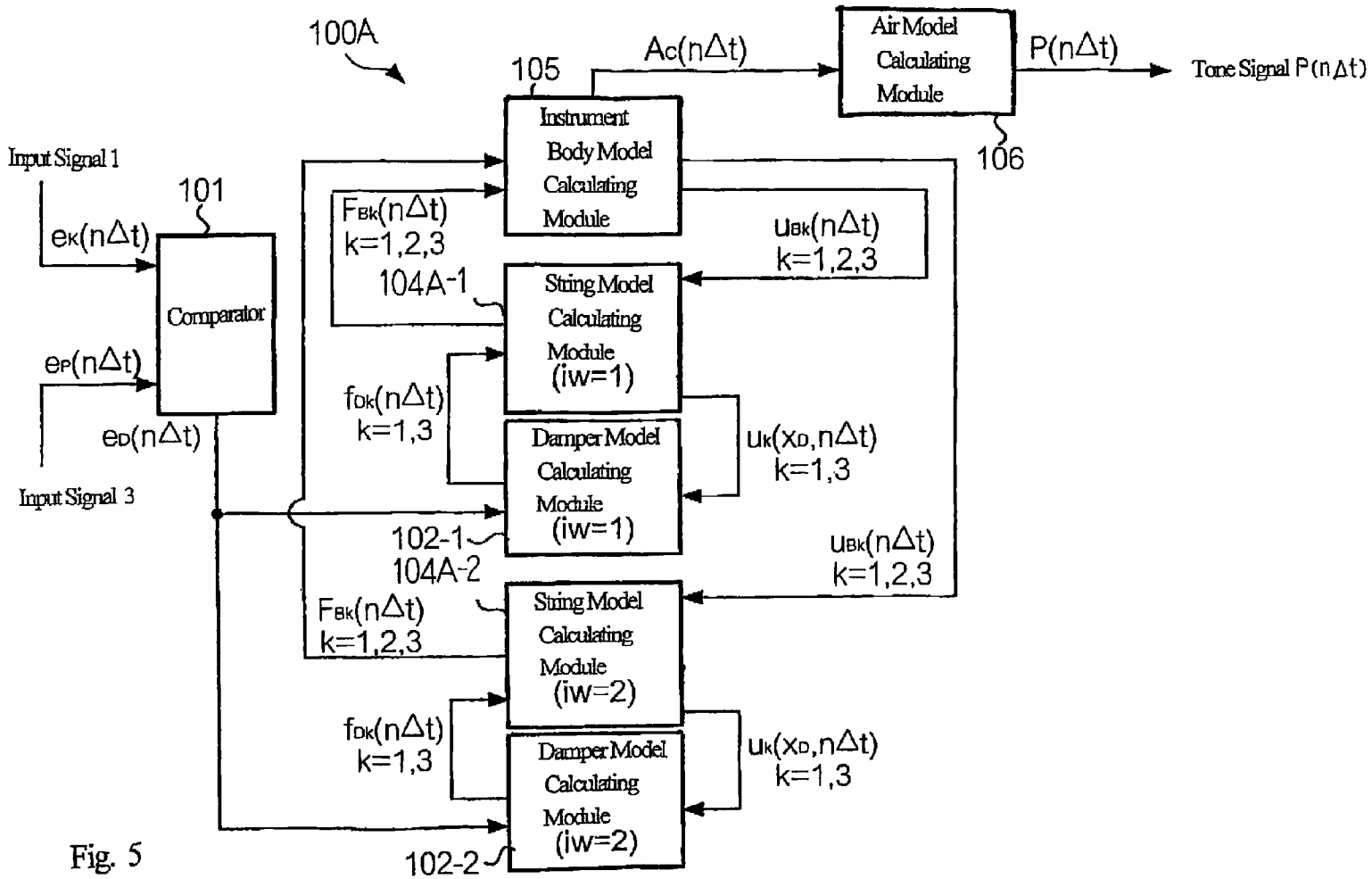
FIG. 5 is a block diagram showing software modules realized through execution of a part of computer program loaded in the electronic piano.

The controller 11A is different from the controller 11 in that a part of the computer program for a hammer model calculating module 103 is not incorporated in the computer program. In other words, any hammer model calculating module 103 is not incorporated in a tone signal synthesizing system 100A of the electronic piano 1A as shown in FIG. 5, and the string model calculating modules 104A-1 and 104A-2 accesses the read only memory of data storage 12A so as to read out the piece of control data expressing the force exerted on the surface of wire by the hammer $f_H^{[iw]}(t)$. The other software modules of the tone signal synthesizing system 100A are similar to those of the tone signal synthesizing system 100, and, for this reason, those modules are labeled with references designating corresponding software modules of the tone signal synthesizing system 100.

Thus, the present invention appertains to the electronic piano 1A equipped with only the damper pedal 16*a*.

Third Embodiment

Figure 6:
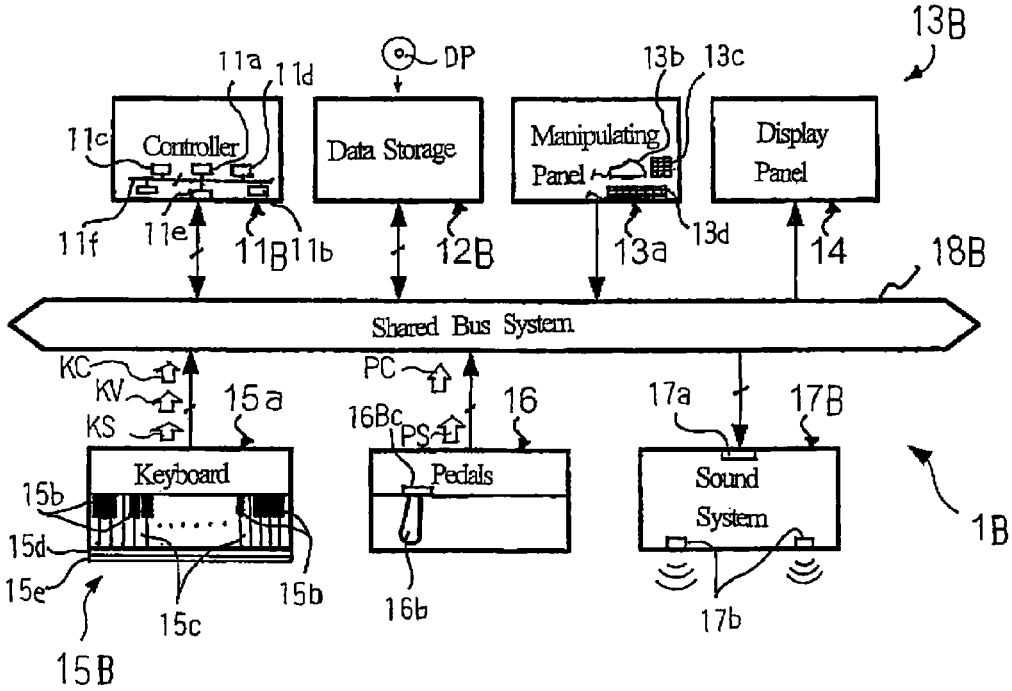
FIG. 6 is a block diagram showing the system configuration of yet another electronic piano of the present invention.

Turning to FIG. 6, an electronic piano 1B embodying the present invention largely comprises a controller 11B, a data storage 12B, a man-machine interface 13B, manipulators 15B, a sound system 17B and a shared bus system 18B. The man-machine interface 13B, sound system 17B and shared bus system 18B are similar to those 13, 17 and 18 of the electronic piano 1, and, for this reason, component parts of the man-machine interface 13B, sound system 17B and shared bus system 18B are labeled with references designating the corresponding component parts of the man-machine interface 13, sound system 17 and shared bus system 18 without detailed description for the sake of simplicity.

The manipulators 15B are different from the manipulators 15 in that the damper pedal 16*a* is deleted therefrom, and, accordingly, a pedal sensor 16Bc monitors only the soft pedal 16*b*. The other features of manipulators 15B are similar to those of the manipulators 15, and no further description is hereinafter incorporated.

The data storage 12B is different from the data storage 12 in that a piece of control data, which expresses the resistance of damper $f_{Dk}(t)$, is stored in the read only memory of data storage 12B. The piece of control data is indicative of the resistance when the soft pedal 16*b* stays at the rest position.

Figure 7:
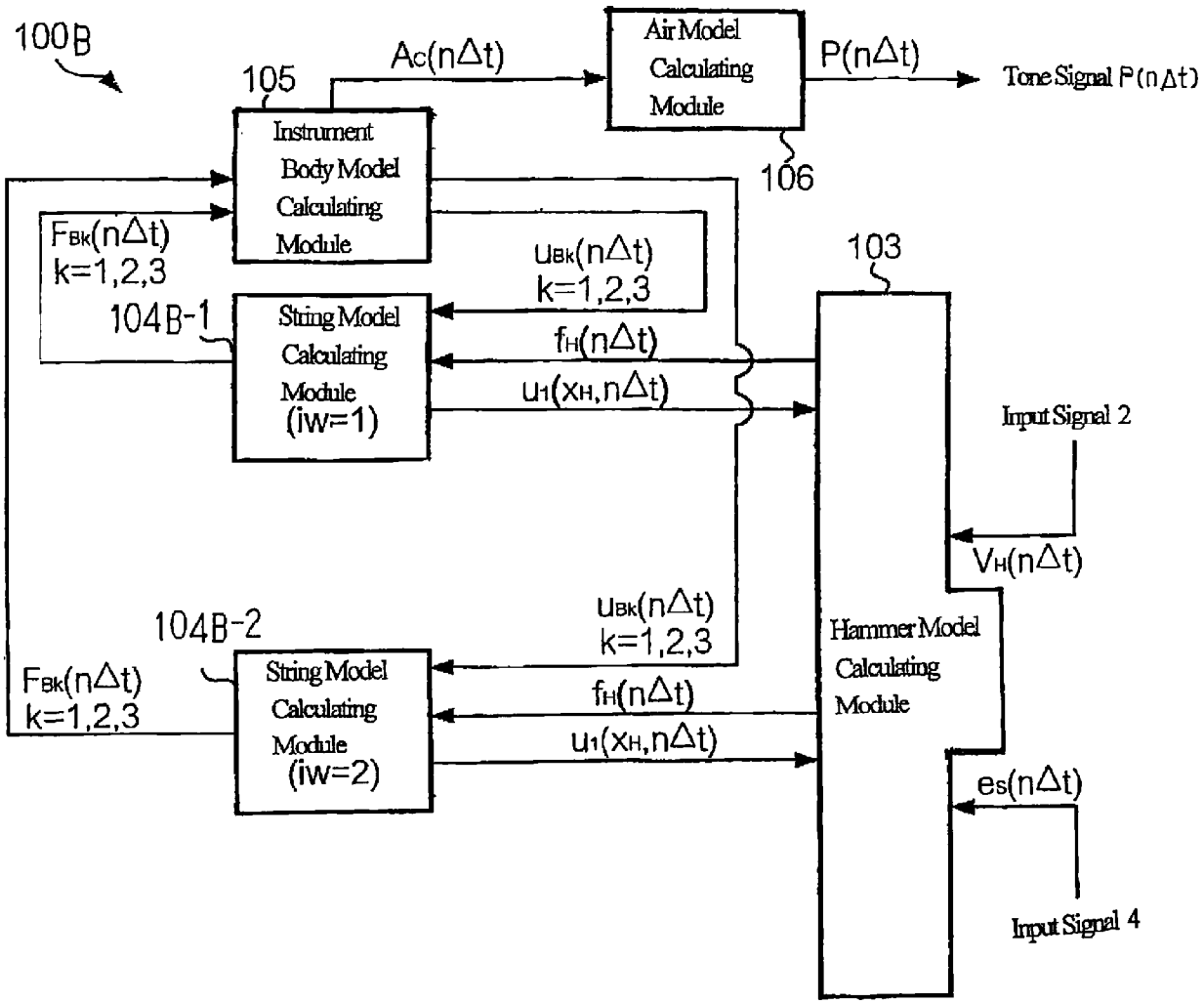
FIG. 7 is a block diagram showing software modules realized through execution of a part of computer program loaded in the electronic piano.

The controller 11B is different from the controller 11 in that a part of the computer program for the comparator 101 and damper model calculating modules 102-1 and 102-2 is not incorporated in the computer program. In other words, neither damper model calculating module nor comparator is incorporated in a tone signal synthesizing system 100B of the electronic piano 1B as shown in FIG. 7, and the string model calculating modules 104B-1 and 104B-2 access the read only memory of data storage 12B so as to read out the piece of control data expressing the resistance of damper $f_{Dk}(t)$. The other software modules of the tone signal synthesizing system 100B are similar to those of the tone signal synthesizing system 100, and, for this reason, those modules are labeled with references designating corresponding software modules of the tone signal synthesizing system 100.

Thus, the present invention appertains to the electronic piano 1B equipped with only the soft pedal 16*b*.

Fourth Embodiment

Figure 8:
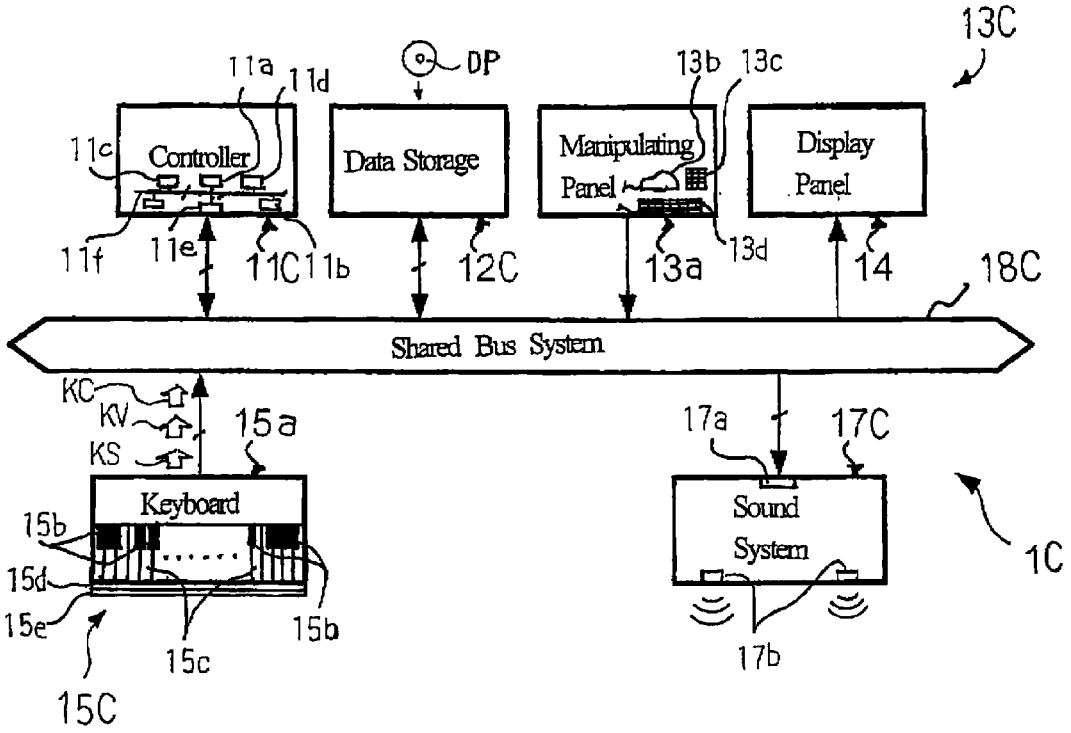
FIG. 8 is a block diagram showing the system configuration of still another electronic piano of the present invention.

Turning to FIG. 8, an electronic piano 1C embodying the present invention largely comprises a controller 11C, a data storage 12C, a man-machine interface 13C, manipulators 15C, a sound system 17C and a shared bus system 18C. The man-machine interface 13C, sound system 17C and shared bus system 18C are similar to those 13, 17 and 18 of the electronic piano 1, and, for this reason, component parts of the man-machine interface 13C, sound system 17C and shared bus system 18C are labeled with references designating the corresponding component parts of the man-machine interface 13, sound system 17 and shared bus system 18 without detailed description for the sake of simplicity.

The manipulators 15C are different from the manipulators 15 in that the damper pedal 16*a* and soft pedal 16*b* are deleted therefrom, and, accordingly, any pedal sensor is not incorporated. The other features of manipulators 15C are similar to those of the manipulators 15, and no further description is hereinafter incorporated.

The data storage 12C is different from the data storage 12 in that a piece of control data, which expresses the resistance of damper $f_{Dk}(t)$, and another piece of control data, which expresses the force exerted on the surface of wire by the hammer $f_H^{[iw]}(t)$, are stored in the read only memory of data storage 12C. The pieces of control data are indicative of the resistance and the force when the damper pedal 16*a* and soft pedal stay at the respective rest positions.

Figure 9:
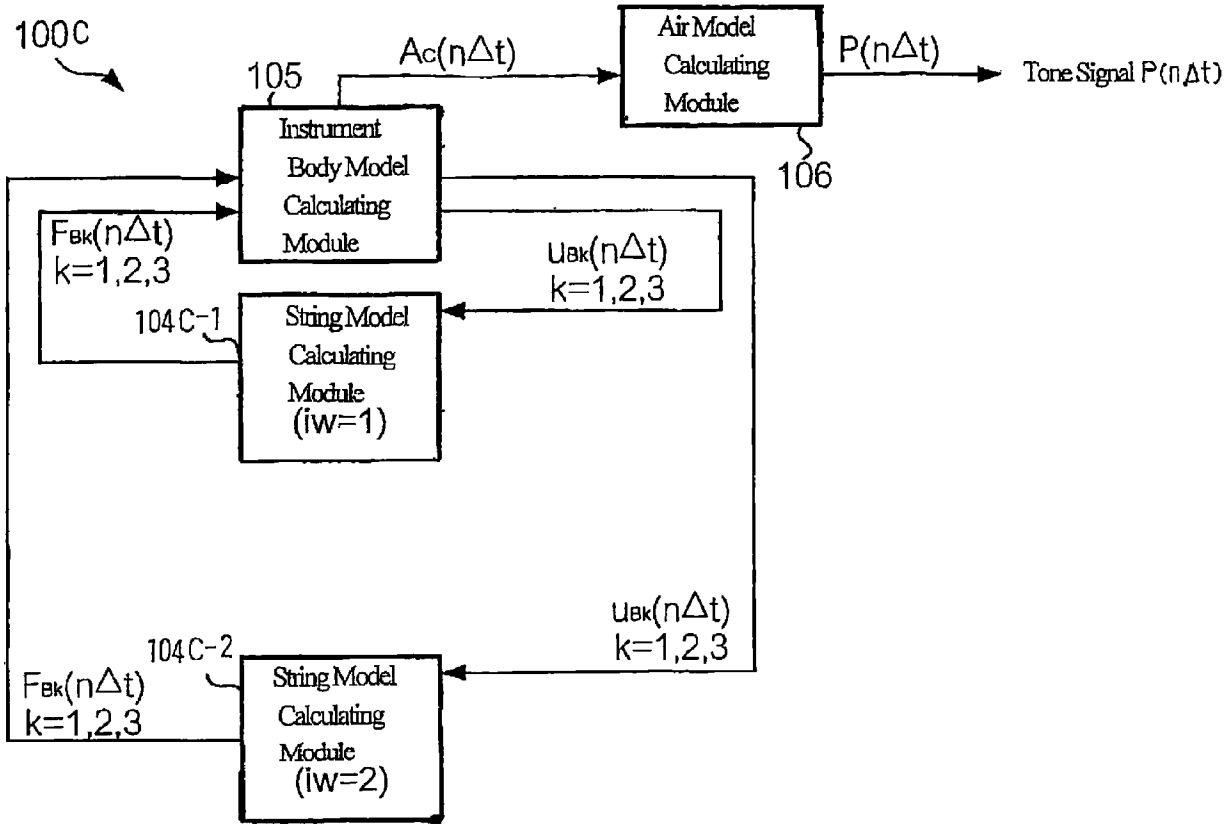
FIG. 9 is a block diagram showing software modules realized through execution of a part of computer program loaded in the electronic piano.

The controller 11C is different from the controller 11 in that a part of the computer program for the comparator 101, damper model calculating modules 102-1 and 102-2 and hammer model calculating module 103 is not incorporated in the computer program. In other words, neither comparator, damper model calculating module nor hammer model calculating module is incorporated in a tone signal synthesizing system 100C of the electronic piano 1C as shown in FIG. 9, and the string model calculating modules 104C-1 and 104C-2 access the read only memory of data storage 12C so as to read out the pieces of control data expressing the resistance of damper $f_{Dk}(t)$ and the force exerted on the surface of wire by the hammer $f_H^{[iw]}(t)$. The other software modules of the tone signal synthesizing system 100C are similar to those of the tone signal synthesizing system 100, and, for this reason, those modules are labeled with references designating corresponding software modules of the tone signal synthesizing system 100.

Thus, the present invention appertains to the electronic piano 1C without any damper pedal 16*a* and soft pedal 16*b*.

Although particular embodiments of the present invention have been shown and described, it will be apparent to those skilled in the art that various changes and modifications may be made without departing from the spirit and scope of the present invention.

The tone signal synthesizing system 100 generates the tone signal in response to the actual movements of keys 15*b* and 15*c* and the actual movements of pedals 16*a* and 16*b*. However, the tone signal synthesizing system 100 may generate the tone signals on the basis of the pieces of music data stored in an information storage medium or downloaded from a suitable data source. In this instance, "variable data on the time base on the basis of the velocity of instrument body at each natural vibration mode in the modal coordinate system" may be determined prior to the convolving calculation on the variable data and "the impulse response between the velocity of instrument body at each natural vibration mode in the modal coordinate system and the sound pressure at the observation point in the air or the frequency response data. This results in easiness of the synthesis of electronic tones under the condition that the observation point is changed.

The signal processing for the synthesis of tone signal may be applied to the synthesis of acoustic tones generated from various acoustic musical instruments which have respective vibratory wires and respective instrument bodies by which the wires are supported and which are also vibratory for radiating acoustic waves into the air. Typical examples of the acoustic musical instruments are cembalos, harps and guitars. In case where, a bridge is held in contact with intermediate points of wires stretched between suitable supporting portions, one of the supported ends of each wire is found at the bridge.

In case where the present invention is applied to a stringed musical instrument, the wires may be plucked by the fingers of a player. There is a stringed musical instrument having only one wire.

The method of present invention may be offered to users in the form of computer program. The computer program may be stored in a magnetic information storage medium such as a magnetic tape cassette or a magnetic disk, an optical information storage medium such as an optical disk, an optomagnetic information storage medium or a computer readable information storage medium such as a semiconductor memory device. Otherwise, the computer program may be downloaded from a server computer through a communication network such as the internet.

The stringed musical instruments do not have any pedals. Moreover, there are various models of keyboard musical instruments without any pedal. The damper model calculating module 102 and hammer model calculating module 103 are not required for the stringed musical instruments and keyboard musical instruments without any pedal. Thus, only the string model calculating module 104, instrument body model calculating module 105 and air model calculating module 106 are the indispensable elements of the tone signal synthesizing system 100 of the present invention.

The tone signal synthesizing system 100 may be partially or entirely realized by wired-logic circuits. For example, the comparator 101 may be replaced with a hardware comparator. The integration and/or differentiation in the physical models 102, 103, 104, 105 and 106 may be carried out by means of hardware integrators and/or hardware differentiators.

More than one tone signal may be produced through the air model calculating module 106 for more than one observation point. In this instance, a plurality of air model calculating modules 106 may be connected to the instrument body model calculating module 105.

The key velocity sensors 15*e* may be deleted from the keyboard 15*a*. Instead, an information processor may be incorporated in the keyboard 15*a* so as to calculate the key velocity on the basis of pieces of key position data. Otherwise, only the digital key position signals KS may be supplied from the keyboard 15*a* to the controller 11. In this instance, the central processing unit 11*a* calculates the key velocity on the basis of the pieces of key position data acquired from the keyboard 15*a* through the digital key position signals KS.

Claim languages are correlated with the signals, modules and component parts of standard acoustic piano as follows. The acoustic piano tones and electronic piano tones are corresponding to "acoustic tones" and "artificial tones", respectively, and the standard piano 21 serves as "an acoustic musical instrument". The wire set, which has one or more than one wires 21*e*, and instrument body 21*j* are corresponding to "at least one vibratory wire" and "a vibratory instrument body", respectively. The bridges 21*ea* and bearings 21*eb* serve as "supporting portions", and the observation point serves as "a certain observation point."

The total of the resistance of damper $f_{Dk}(n\Delta t)$ and the force exerted on the surface of wire by the hammer head $f_H(n\Delta t)$ is corresponding to "force exerted on said at least one wire" expressed by "a first piece of data".

The displacement at the supported ends $u_{Bk}(n\Delta t)$ is corresponding to "a displacement at each of said supporting portions" expressed by "a second piece of data."

The displacement of wire $A_k^{[mk]}(n\Delta t)$ is corresponding to "a displacement of another point of said at least one vibratory wire between said supporting portions on a modal coordinate" expressed by "a third piece of data".

The force $F_{Bk}^{[iB]}$ exerted on the supported ends by the wire is corresponding to "force exerted on said supporting portions", and the force $F_{Bk}^{[iB]}$ is calculated by using equations 30, 31 and 32. The equation 28 and 29 serve as "equations defining relation between said displacement at said supporting portions and said force exerted on said supporting portions."

The displacement of instrument body $A_c(n\Delta t)$ is corresponding to "a displacement of said vibratory instrument body on a modal coordinate" expressed by "a fifth piece of data." "A velocity of said vibratory instrument body" also expressed by the fifth piece of data is expressed by "$D_\tau A_C^{[m]}(t-\tau)$" found in equation 41. $\omega c^{[m]}$, $\zeta_C^{[m]}$ and m are corresponding to "a natural angular frequency, a modal damping ratio and components of natural vibration modes of said vibratory instrument body" expressed by "a sixth piece of data", and equation 35 is corresponding to "an equation of motion."

$\phi_{Bk}^{[iB][m]}$ in equations 36 and 37 is corresponding to "natural vibration modes of said vibratory instrument body at said supporting portions", and $\beta_{kk'}$ is corresponding to "a direction cosine among the coordinate axes".

$P(n\Delta t)$ is corresponding to "a sound pressure" expressed by "a seventh piece of data".

$\hat{h}^{[ip][m]}(\tau)$ in equation 41 expresses "an impulse response".

$D_\tau A_C^{[m]}(t-\tau)$ in equation 41 expresses "a velocity of said vibratory instrument body on said modal coordinate system". Equation 41 expresses "a convolution."

The arrows labeled with "$F_{Dk}(n\Delta t)$", "$F_H(n\Delta t)$" and "$u_{Bk}(n\Delta t)$" in FIG. 2 is corresponding to "a first sub-module", and the equations 9, 10, 11, 12, 12, 13, 14 and 15 stand for "a second sub-module." The equations 16, 17, 18, 19, 20, 21, 22, 23, 24, 25, 26, 27, 28, 29, 30, 31, 32, 33 and 34 stand for "a third sub-module".

The equations 35 and 36 stand for "a fourth sub-module", and the equation 37 is representative of "a fifth sub-module", and the arrow labeled with "$u_{Bk}(n\Delta t)$" in FIG. 2 is corresponding to "a sixth sub-module."

The equations 38, 39, 40, 41, 42 and 43 stand for "a seventh sub-module", and the arrow labeled with $P_n(n\Delta t)$ in FIG. 2 is corresponding to "an eighth sub-module."

The string model calculating modules 104-1 and 104-2, instrument body model calculating module 105 and air model calculating module 106 form in combination "a tone signal producing module."

What is claimed is:

1. A method of simulating acoustic tones produced through an acoustic musical instrument having at least one vibratory wire and a vibratory instrument body provided with supporting portions through which said at least one wire is supported for producing a tone signal representative of artificial tones close to said acoustic tones and observed at a certain point in the air, comprising the steps of:

a) acquiring a first piece of data expressing force exerted on said at least one vibratory wire and a second piece of data expressing a displacement at each of said supporting portions;

b) determining a third piece of data expressing a displacement of said at least one vibratory wire on a modal coordinate system for each natural vibration mode and calculated by using an equation of motion defining relation between said first piece of data and said second piece of data and said third piece of data, c) determining a fourth piece of data expressing force exerted on the supporting portions by said at least one vibratory wire and calculated by using a direction cosine among the coordinate axes and equations defining relation between said second piece of data and said third piece of data and said fourth piece of data, d) determining a fifth piece of data expressing a displacement or a velocity of said vibratory instrument body on said modal coordinate system approximated to a proportional viscous damping system on the basis of said fourth piece of data and a sixth piece of data expressing a natural angular frequency, a modal damping ratio and components of natural vibration modes of said vibratory instrument body by using an equation of motion defining relation between said forth piece of data and said fifth piece of data;

e) determining said second piece of data as a sum of products among values of said fifth piece of data, natural vibration modes of said vibratory instrument body at said supporting portions and said direction cosine among the coordinate axes;

f) supplying said second piece of data to said step a);

g) determining a seventh piece of data expressing a sound pressure radiated from said vibratory instrument body and observed at said certain point in the air on the basis of said fifth piece of data as a sum of calculation results through a convolution between a velocity of said vibratory instrument body on said modal coordinate system and an eighth piece of data expressing an impulse response or a frequency response between said velocity of said vibratory instrument body on said modal coordinate system and said sound pressure at said certain point in the air; and h) producing said tone signal representative of said seventh piece of data and expressing said artificial tones.

2. The method as set forth in claim 1, in which relation between a displacement of a centerline of said at least one vibratory wire and said second piece of data and said third piece of data is expressed as $$u_k(x,t)=\sum_{mk=1}^{Mk} A_k^{[mk]}(t)\sin(m_k\pi x)/\iota+\left(\frac{x}{\iota}\right)u_{Bk}^{[iB]}(t)\Big|_{iB=0}+\left\{\frac{(\iota-x)}{\iota}\right\}u_{Bk}^{[iB]}(t)\Big|_{iB=1}$$

where k is 1, 2 and 3, x is said spatial variable, t is said time variable, $u_1(x, t)$ expresses a displacement of a centerline of said at least one vibratory wire in a z-direction of a coordinate system, $u_2(x, t)$ expresses a displacement of said centerline of said at least one vibratory wire in an x-direction of said coordinate system, $u_3(x, t)$ expresses a displacement of said centerline of said at least one vibratory wire in a y-direction of said coordinate system, $A_1^{[m1]}(t)$ expresses a displacement of said at least one vibratory wire in a z-direction in a natural vibration mode of bending vibrations in a modal coordinate system, $A_2^{[m2]}(t)$ expresses a displacement of said at least one vibratory wire in an x-direction in said natural vibration mode of longitudinal vibrations in said modal coordinate system, $A_3^{[m3]}(t)$ expresses a displacement of said at least one vibratory wire in a y-direction in said natural vibration mode of said bending vibrations in said modal coordinate system, $m_1$ expresses a number assigned to said natural vibration modes of said bending vibrations of said at least one vibratory wire, and $m_2$ expresses a number assigned to said natural vibration modes of said longitudinal vibrations of said at least one vibratory wire, $m_3$ expresses a number assigned to said natural vibration modes of said bending vibrations of said at least one vibratory wire, $\iota$ expresses a length of said at least one vibratory wire in a static equilibrium, and $u_{Bk}^{[iB]}(t)$ expresses a displacement of said at least one vibratory wire at said supporting portions.

3. The method as set forth in claim 1, in which said acoustic musical instrument is a piano including a plurality of vibratory wires containing said at least one vibratory wire, plural keys respectively associated with said plurality of vibratory wires, plural action units linked with said plural keys, respectively, plural hammers driven for rotation by said plural action units, respectively, plural dampers linked with said plural keys and spaced from and brought into contact with said plurality of vibratory wires depending upon positions of said plural keys, and a damper pedal linked with said plural dampers so as to make said plural dampers spaced from and brought into contact with said plurality of wires regardless of said positions of said plural keys.

4. The method as set forth in claim 3, in which said force expressed by said first piece of data contains resistance of each of said plural dampers against vibrations of one of said plurality of vibratory wires, and said resistance is expressed as $$f_{Dk}(t)=b_De_D(t)Dt\,u_k(x_D^{[iD]},t)$$

where Dt stands for d/dt, k is 1 and 3, $f_{Dk}(t)$ expresses said resistance, $b_De_D(t)$ expresses a viscous coefficient of said each of said plural dampers, $u_k(x_D^{[iD]}, t)$ expresses the amount of deformation of said each of said plural dampers, x is a spatial variable, t is a time variable, $x_D^{[iD]}$ expresses an x-coordinate of a tone decay point of said each of said plural dampers in a coordinate system, and said tone decay point is a position of said each of said plural dampers at which said each of said plural dampers is brought into contact with and spaced from said one of said plurality of vibratory wires.

5. The method as set forth in claim 1, in which said acoustic musical instrument is a piano including a plurality of vibratory wires containing said at least one vibratory wire, plural keys respectively associated with said plurality of vibratory wires, plural action units linked with said plural keys, respectively, plural hammers driven for rotation by said plural action units, respectively, plural dampers linked with said plural keys and spaced from and brought into contact with said plurality of vibratory wires depending upon positions of said plural keys, and a soft pedal linked with said plural keys and making impact points on said plural hammers offset with respect to positions of said plurality of vibratory wires.

6. The method as set forth in claim 5, in which said force expressed by said first piece of data contains impact force exerted on a surface of each of said a plurality of wires by one of said plural hammers, and said impact force is expressed as $$f_H^{[iw]}(t)=K_H e_S^{[is]}(t)\{w_e^{[iw]}(t)\}^P$$

where $f_H^{[iw]}(t)$ expresses said impact force, $K_H e_S^{[is]}(t)$ expresses modulus of elasticity of said one of said plural hammers, $e_S^{[is]}(t)$ is equal to 1 when the soft pedal stays at the rest position, $e_S^{[1]}(t)$ is equal to or less than 1 and greater than zero, i.e., $1 \geqq e_S^{[1]}(t)>0$ when said soft pedal is found on the way to an end position, $e_S^{[1]}(t)$ is less than 1 and greater than zero, i.e., $1>e_S^{[1]}(t)>0$ when said soft pedal is perfectly depressed, $e_S^{[2]}(t)$ is equal to or less than 1 and equal to or greater than 0, i.e., $1 \geqq e_S^{[2]}(t) \geqq 0$ when the soft pedal is found on the way to said end position, $e_S^{[2]}(t)$ is equal to zero when said soft pedal is perfectly depressed, $w_e(t)=w_H(t)-u_1(x_H, t) \geqq 0$ when said one of said plural hammers is in contact with said each of said plurality of vibratory wires, $w_e(t)=0$ and $w_H(t)-u_1(x_H, t)<0$ when said one of said plural hammers is spaced from said each of said plurality of vibratory wires.

7. The method as set forth in claim 1, in which said acoustic musical instrument is a piano including a plurality of vibratory wires containing said at least one vibratory wire, plural keys respectively associated with said plurality of vibratory wires, plural action units linked with said plural keys, respectively, plural hammers driven for rotation by said plural action units, respectively, plural dampers linked with said plural keys and spaced from and brought into contact with said plurality of vibratory wires depending upon positions of said plural keys, a damper pedal linked with said plural dampers so as to make said plural dampers spaced from and brought into contact with said plurality of wires regardless of said positions of said plural keys, and a soft pedal linked with said plural keys and making impact points on said plural hammers offset with respect to positions of said plurality of vibratory wires.

8. The method as set forth in claim 7, in which said force expressed by said first piece of data contains resistance of each of said plural dampers against vibrations of one of said plurality of vibratory wires and impact force exerted on a surface of each of said a plurality of wires by one of said plural hammers, said resistance is expressed as $$f_{Dk}(t)=b_D e_D(t) Dtu_k(x_D^{[iD]},t)$$

where Dt stands for d/dt, k is 1 and 3, $f_{Dk}(t)$ expresses said resistance, $b_D e_D(t)$ expresses a viscous coefficient of said each of said plural dampers, $u_k(x_D^{[iD]}, t)$ expresses the amount of deformation of said each of said plural dampers, x is a spatial variable, t is a time variable, $x_D^{[iD]}$ expresses an x-coordinate of a tone decay point of said each of said plural dampers in a coordinate system, and said tone decay point is a position of said each of said plural dampers at which said each of said plural dampers is brought into contact with and spaced from said one of said plurality of vibratory wires, and said impact force is expressed as $$f_H^{[iw]}(t)=K_H e_S^{[is]}(t)\{w_e^{[iw]}(t)\}^P$$

where $f_H^{[iw]}(t)$ expresses said impact force, $K_H e_S^{[is]}(t)$ expresses modulus of elasticity of said one of said plural hammers, $e_S^{[is]}(t)$ is equal to 1 when the soft pedal stays at the rest position, $e_S^{[1]}(t)$ is equal to or less than 1 and greater than zero, i.e., $1 \geqq e_S^{[1]}(t)>0$ when said soft pedal is found on the way to an end position, $e_S^{[1]}(t)$ is less than 1 and greater than zero, i.e., $1>e_S^{[1]}(t)>0$ when said soft pedal is perfectly depressed, $e_S^{[2]}(t)$ is equal to or less than 1 and equal to or greater than 0, i.e., $1 \geqq e_S^{[2]}(t) \geqq 0$ when the soft pedal is found on the way to said end position, $e_S^{[2]}(t)$ is equal to zero when said soft pedal is perfectly depressed, $w_e(t)=w_H(t)-u_1(x_H, t) \geqq 0$ when said one of said plural hammers is in contact with said each of said plurality of vibratory wires, $w_e(t)=0$ and $w_H(t)-u_1(x_H, t)<0$ when said one of said plural hammers is spaced from said each of said plurality of vibratory wires.

9. A tone signal synthesizing system for producing a tone signal representative of artificial tones close to acoustic tones produced through an acoustic musical instrument having at least one vibratory wire and a vibratory instrument body provided with supporting portions through which said at least one wire is supported, comprising:

a string model calculating module including a first sub-module acquiring a first piece of data expressing force exerted on said at least one vibratory wire and a second piece of data expressing a displacement at each of said supporting portions, a second sub-module determining a third piece of data expressing a displacement of said at least one vibratory wire on a modal coordinate system for each natural vibration mode by using an equation of motion defining relation between said force exerted on said at least one vibratory wire and the displacement at each of said supporting portions and said displacement of said at least one vibratory wire on a modal coordinate system for each natural vibration mode, and a third sub-module determining a fourth piece of data expressing force exerted on the supporting portions by said at least one vibratory wire and calculated by using a direction cosine among the coordinate axes and equations defining relation between said second piece of data and said third piece of data and said fourth piece of data;

an instrument body model calculating module including a fourth sub-module determining a fifth piece of data expressing a displacement or a velocity of said vibratory instrument body on said modal coordinate system approximated to a proportional viscous damping system on the basis of said fourth piece of data and a sixth piece of data expressing a natural angular frequency of said vibratory instrument body, a modal damping ratio and components of natural vibration modes by using an equation of motion defining relation between said force exerted on said supporting portions by said at least one vibratory wire and said displacement of said vibratory instrument body in said modal coordinate system for each natural vibration mode, a fifth sub-module determining said second piece of data as a sum of products among values of said fifth piece of data, natural vibration modes of said vibratory instrument body at said supporting portions and said direction cosine among the coordinate axes, and a sixth sub-module supplying said second piece of data to said string model calculating module; and an air model calculating module a seventh sub-module determining a seventh piece of data expressing a sound pressure radiated from said vibratory instrument body and observed at said certain point in the air on the basis of said fifth piece of data as a sum of calculation results through a convolution between a velocity of said vibratory instrument body on said modal coordinate system and an eighth piece of data expressing an impulse response or a frequency response between said velocity of said vibratory instrument body on said modal coordinate system and said sound pressure at said certain point in the air, and an eighth sub-module producing a tone signal representative of said seventh piece of data and expressing said artificial tones.

10. The tone signal synthesizing system as set forth in claim 9, in which relation between a displacement of a centerline of said at least one vibratory wire and said second piece of data and said third piece of data is expressed as $$u_k(x,t)=\sum_{mk=1}^{Mk}A_k^{[mk]}(t)\sin(m_k\pi x)/\iota+\left(\frac{x}{\iota}\right)u_{Bk}^{[iB]}(t)\Big|_{iB=0}+\left\{\frac{(\iota-x)}{\iota}\right\}u_{Bk}^{[iB]}(t)\Big|_{iB=1}$$

where k is 1, 2 and 3, x is said spatial variable, t is said time variable, $u_1(x, t)$ expresses a displacement of a centerline of said at least one vibratory wire in a z-direction of a coordinate system, $u_2(x, t)$ expresses a displacement of said centerline of said at least one vibratory wire in an x-direction of said coordinate system, $u_3(x, t)$ expresses a displacement of said centerline of said at least one vibratory wire in a y-direction of said coordinate system, $A_1^{[m1]}(t)$ expresses a displacement of said at least one vibratory wire in a z-direction in a natural vibration mode of bending vibrations in a modal coordinate system, $A_2^{[m2]}(t)$ expresses a displacement of said at least one vibratory wire in an x-direction in said natural vibration mode of longitudinal vibrations in said modal coordinate system, $A_3^{[m3]}(t)$ expresses a displacement of said at least one vibratory wire in a y-direction in said natural vibration mode of said bending vibrations in said modal coordinate system, $m_1$ expresses a number assigned to said natural vibration modes of said bending vibrations of said at least one vibratory wire, and $m_2$ expresses a number assigned to said natural vibration modes of said longitudinal vibrations of said at least one vibratory wire, $m_3$ expresses a number assigned to said natural vibration modes of said bending vibrations of said at least one vibratory wire, c expresses a length of said at least one vibratory wire in a static equilibrium, and $u_{Bk}^{[iB]}(t)$ expresses a displacement of said at least one vibratory wire at said supporting portions.

11. The tone signal synthesizing system as set forth in claim 9, in which said acoustic musical instrument is a piano including a plurality of vibratory wires containing said at least one vibratory wire, plural keys respectively associated with said plurality of vibratory wires, plural action units linked with said plural keys, respectively, plural hammers driven for rotation by said plural action units, respectively, plural dampers linked with said plural keys and spaced from and brought into contact with said plurality of vibratory wires depending upon positions of said plural keys, and a damper pedal linked with said plural dampers so as to make said plural dampers spaced from and brought into contact with said plurality of wires regardless of said positions of said plural keys.

12. The tone signal synthesizing system as set forth in claim 11, in which said force expressed by said first piece of data contains resistance of each of said plural dampers against vibrations of one of said plurality of vibratory wires, and said resistance is expressed as $$f_{Dk}(t)=b_De_D(t)Dtu_k(x_D^{[iD]},t)$$

where Dt stands for d/dt, k is 1 and 3, $f_{Dk}(t)$ expresses said resistance, $b_De_D(t)$ expresses a viscous coefficient of said each of said plural dampers, $u_k(x_D^{[iD]}, t)$ expresses the amount of deformation of said each of said plural dampers, x is a spatial variable, t is a time variable, $x_D^{[iD]}$ expresses an x-coordinate of a tone decay point of said each of said plural dampers in a coordinate system, and said tone decay point is a position of said each of said plural dampers at which said each of said plural dampers is brought into contact with and spaced from said one of said plurality of vibratory wires.

13. The tone signal synthesizing system as set forth in claim 9, in which in which said acoustic musical instrument is a piano including a plurality of vibratory wires containing said at least one vibratory wire, plural keys respectively associated with said plurality of vibratory wires, plural action units linked with said plural keys, respectively, plural hammers driven for rotation by said plural action units, respectively, plural dampers linked with said plural keys and spaced from and brought into contact with said plurality of vibratory wires depending upon positions of said plural keys, and a soft pedal linked with said plural keys and making impact points on said plural hammers offset with respect to positions of said plurality of vibratory wires.

14. The tone signal synthesizing system as set forth in claim 13, in which said force expressed by said first piece of data contains impact force exerted on a surface of each of said a plurality of wires by one of said plural hammers, and said impact force is expressed as $$f_H^{[iw]}(t)=K_He_S^{[is]}(t)\{w_e^{[iw]}(t)\}^P$$

where $f_H^{[iw]}(t)$ expresses said impact force, $K_He_S^{[is]}(t)$ expresses modulus of elasticity of said one of said plural hammers, $e_S^{[is]}(t)$ is equal to 1 when the soft pedal stays at the rest position, $e_S^{[1]}(t)$ is equal to or less than 1 and greater than zero, i.e., $1\geqq e_S^{[1]}(t)>0$ when said soft pedal is found on the way to an end position, $e_S^{[1]}(t)$ is less than 1 and greater than zero, i.e., $1>e_S^{[1]}(t)>0$ when said soft pedal is perfectly depressed, $e_S^{[2]}(t)$ is equal to or less than 1 and equal to or greater than 0, i.e., $1\geqq e_S^{[2]}(t)\geqq 0$ when the soft pedal is found on the way to said end position, $e_S^{[2]}(t)$ is equal to zero when said soft pedal is perfectly depressed, $w_e(t)=w_H(t)-u_1(x_H, t)\geqq 0$ when said one of said plural hammers is in contact with said each of said plurality of vibratory wires, $w_e(t)=0$ and $w_H(t)-u_1(x_H, t)<0$ when said one of said plural hammers is spaced from said each of said plurality of vibratory wires.

15. The tone signal synthesizing system as set forth in claim 9, in which said acoustic musical instrument is a piano including a plurality of vibratory wires containing said at least one vibratory wire, plural keys respectively associated with said plurality of vibratory wires, plural action units linked with said plural keys, respectively, plural hammers driven for rotation by said plural action units, respectively, plural dampers linked with said plural keys and spaced from and brought into contact with said plurality of vibratory wires depending upon positions of said plural keys, a damper pedal linked with said plural dampers so as to make said plural dampers spaced from and brought into contact with said plurality of wires regardless of said positions of said plural keys, and a soft pedal linked with said plural keys and making impact points on said plural hammers offset with respect to positions of said plurality of vibratory wires.

16. The tone signal synthesizing system as set forth in claim 15, in which said force expressed by said first piece of data contains resistance of each of said plural dampers against vibrations of one of said plurality of vibratory wires and impact force exerted on a surface of each of said a plurality of wires by one of said plural hammers, said resistance is expressed as $$f_{Dk}(t)=b_D e_D(t) Dt u_k(x_D^{[iD]},t)$$

where Dt stands for d/dt, k is 1 and 3, $f_{Dk}(t)$ expresses said resistance, $b_D e_D(t)$ expresses a viscous coefficient of said each of said plural dampers, $u_k(x_D^{[iD]}, t)$ expresses the amount of deformation of said each of said plural dampers, x is a spatial variable, t is a time variable, $x_D^{[iD]}$ expresses an x-coordinate of a tone decay point of said each of said plural dampers in a coordinate system, and said tone decay point is a position of said each of said plural dampers at which said each of said plural dampers is brought into contact with and spaced from said one of said plurality of vibratory wires, and said impact force is expressed as $$f_H^{[iw]}(t)=K_H e_S^{[is]}(t)\{w_e^{[iw]}(t)\}^P$$

where $f_H^{[iw]}(t)$ expresses said impact force, $K_H e_S^{[is]}(t)$ expresses modulus of elasticity of said one of said plural hammers, $e_S^{[is]}(t)$ is equal to 1 when the soft pedal stays at the rest position, $e_S^{[1]}(t)$ is equal to or less than 1 and greater than zero, i.e., $1 \geqq e_S^{[1]}(t)>0$ when said soft pedal is found on the way to an end position, $e_S^{[1]}(t)$ is less than 1 and greater than zero, i.e., $1>e_S^{[1]}(t)>0$ when said soft pedal is perfectly depressed, $e_S^{[2]}(t)$ is equal to or less than 1 and equal to or greater than 0, i.e., $1 \geqq e_S^{[2]}(t) \geqq 0$ when the soft pedal is found on the way to said end position, $e_S^{[2]}(t)$ is equal to zero when said soft pedal is perfectly depressed, $w_e(t)=w_H(t)-u_1(x_H, t) \geqq 0$ when said one of said plural hammers is in contact with said each of said plurality of vibratory wires, $w_e(t)=0$ and $w_H(t)-u_1(x_H, t)<0$ when said one of said plural hammers is spaced from said each of said plurality of vibratory wires.

* * * * *